US007331408B2

(12) United States Patent
Arich et al.

(10) Patent No.: US 7,331,408 B2
(45) Date of Patent: Feb. 19, 2008

(54) POWER TOOL HOUSING

(75) Inventors: Klaus-Dieter Arich, Huenstetten-Beuerbach (DE); Erhard Benner, Hellenhahn (DE); Manfred Droste, Limburg-Offheim (DE); Uwe Nemetz, Hünfelden Nauheim (DE); Martin Soika, Idstein (DE); Michael Kunz, Dorndorf (DE)

(73) Assignee: Black & Decker Inc., Newark, DE (US)

( * ) Notice: Subject to any disclaimer, the term of this patent is extended or adjusted under 35 U.S.C. 154(b) by 0 days.

(21) Appl. No.: 11/321,483

(22) Filed: Dec. 29, 2005

(65) Prior Publication Data

US 2006/0144603 A1 Jul. 6, 2006

(30) Foreign Application Priority Data

Dec. 23, 2004 (GB) ..... 0428210.9
May 27, 2005 (GB) ..... 0510933.5

(51) Int. Cl.
*B25D 11/04* (2006.01)

(52) U.S. Cl. ..... 173/201; 173/210; 173/217

(58) Field of Classification Search ..... 173/201, 173/48, 217, 162.1, 162.2, 210, 109, 211, 173/162

See application file for complete search history.

(56) References Cited

U.S. PATENT DOCUMENTS 1,841,781 A 1/1932 Bisschop et al.
1,990,035 A 2/1935 Kratz et al.
2,373,665 A 4/1945 Emery
2,456,571 A 12/1948 Turner et al.
3,147,549 A 9/1964 Aspeek
3,456,740 A 7/1969 Paule et al.
3,718,193 A 2/1973 Wanner
3,741,317 A 6/1973 Unterschweiger et al.
3,748,507 A 7/1973 Sieber
3,845,336 A 10/1974 Moores, Jr. et al.
4,284,148 A 8/1981 Wanner et al.
4,442,906 A * 4/1984 Simpson ..... 173/48
4,582,144 A * 4/1986 Mizutani ..... 173/14
4,609,053 A 9/1986 Ragnmark
4,611,670 A * 9/1986 Chromy ..... 173/201
4,766,963 A 8/1988 Hartwig et al.
5,052,497 A 10/1991 Houben et al.
5,320,177 A 6/1994 Shibata et al.
5,435,397 A * 7/1995 Demuth ..... 173/109
5,775,440 A * 7/1998 Shinma ..... 173/109
5,954,140 A * 9/1999 Bauer ..... 173/48
6,076,616 A * 6/2000 Kramp et al. ..... 173/162.2
6,123,158 A 9/2000 Steffen
6,127,751 A 10/2000 Kristen et al.
6,170,579 B1 * 1/2001 Wadge ..... 173/216
6,325,157 B1 12/2001 Arakawa et al.

(Continued)

*Primary Examiner*—Scott A. Smith
(74) *Attorney, Agent, or Firm*—Michael P. Leary; Charles E. Yocum; Adan Ayala

(57) ABSTRACT

A transmission housing for a hammer drill comprises two clamshell halves and that mate to define a first transmission housing chamber and a second transmission housing chamber disposed on either side of a ball bearing race. The first and second transmission housing chambers are interconnected by channels. The rear end of a hollow piston, a cylindrical bearing, a crank pin and a crank plate are disposed in the first transmission housing chamber, and a spindle is disposed in the second transmission housing chamber. Overflow channels and allow movement of air between the first and second transmission housing chambers to reduce compression of air iduring reciprocation of the hollow piston.

21 Claims, 25 Drawing Sheets

U.S. PATENT DOCUMENTS 6,484,814 B2 * 11/2002 Bongers-Ambrosius ..... 173/2
6,523,622 B1 * 2/2003 Berger et al. ..... 173/212
6,543,549 B1 4/2003 Riedl et al.
6,575,254 B2 6/2003 Bongers-Ambrosius et al.
6,763,897 B2 7/2004 Hanke et al.
6,776,245 B2 8/2004 Kristen et al.
6,866,105 B2 3/2005 Pfisterer et al.
6,913,089 B2 * 7/2005 Stirm ..... 173/104
6,962,211 B2 * 11/2005 Daubner et al. ..... 173/162.2
6,988,563 B2 * 1/2006 Hashimoto et al. ..... 173/48
2003/0070823 A1 4/2003 Kristen et al.
2004/0124721 A1 7/2004 Pfisterer et al.
2004/0251039 A1 12/2004 Berger et al.

* cited by examiner

FIG.15.c

POWER TOOL HOUSING

FIELD OF THE INVENTION

The present invention relates to a transmission housing for a power tool, and to a power tool incorporating such a transmission housing. The invention relates particularly, but not explicitly, to a transmission housing for a hammer drill, and to a hammer drill incorporating such a transmission housing.

BACKGROUND OF THE INVENTION

Hammer drills are power tools that can generally operate in three modes of operation. The hammer drill will have a tool bit that can be operated in a hammer mode, a rotary mode and a combined hammer and rotary mode.

In order to generate a hammering action, a hammer drill will generally have a hollow piston that is caused to reciprocate by the transmission mechanism of the hammer drill. Prior art hammer drills can suffer from the drawback that the free end of the hollow piston that is caused to reciprocate by the transmission mechanism repeatedly compresses any air trapped inside the hammer drill as it reciprocates. This does unnecessary work on the trapped air which reduces the efficiency of the hammer drill and reduces the battery life of a battery powered hammer drill.

Preferred embodiments of the present invention seek to overcome the above disadvantages of the prior art.

BRIEF SUMMARY OF THE INVENTION

According to an aspect of the present invention, there is provided a transmission housing for a power tool having an outer housing for gripping by a user, a motor disposed in the outer housing, and a transmission mechanism for driving a reciprocating member in response to rotation of an output shaft of the motor in order to actuate a working member of the tool, the transmission housing adapted to at least partially encapsulate the transmission mechanism to define a first chamber for receiving a rear end of said reciprocating member, and a second chamber remote from said first chamber, wherein said first and second chambers are connected in use by at least one channel in order to allow air flow between said first and second chambers to reduce pressure differences generated by the reciprocation of said rear end of the reciprocating member.

A transmission housing that defines a first chamber into which a rear end of a reciprocating member is caused to reciprocate, and defining a second chamber disposed remote from the first chamber, wherein said first and second chambers are connected in use by at least one channel in order to allow air flow between said first and second chambers, provides the advantage that some of the air trapped in the transmission housing during operation of the power tool can be pushed by the rear end of the reciprocating member from the first chamber into the second chamber as the rear end enters the first chamber. This means that the trapped air can be accommodated by the greater volume provided by two chambers. This reduces the amount of energy that would be lost in compressing air trapped in the first chamber only. The flow of the trapped air between the first and second chambers also helps to cool the transmission mechanism.

Preferably, the second chamber is for receiving a front end of said reciprocating member. This has the advantage that air trapped in the transmission housing can also be pushed by the front end of the reciprocating member from the second chamber into the first chamber as the front end enters the second chamber. This creates a cycle of back and forth air movement in the overflow channels whereby compression of the trapped air is eliminated, or significantly reduced, during reciprocation of the reciprocating member. As such, the reciprocating member does less work and loses less energy through inadvertently compressing trapped air. This increases the efficiency of the motor and increases the battery life of a battery powered tool.

In a preferred embodiment, the transmission housing is formed from a plurality of clamshell portions.

At least one clamshell portion may define at least one respective said channel.

According to another aspect of the present invention, there is provided a power tool comprising an outer housing for gripping by a user, a motor disposed in the outer housing, a transmission mechanism for actuating a working member of the tool in response to rotation of an output shaft of the motor and a transmission housing as defined above.

In a preferred embodiment, the power tool further comprises a plurality of internal guide rails on which the transmission housing is slidably mounted.

The power tool may further comprise biasing means for damping vibrations of the transmission mechanism transmitted to the outer housing.

This provides the advantage of reducing the amount of vibration transmitted to a user.

Said biasing means may comprise at least one coil spring.

In a preferred embodiment, the power tool is a hammer drill.

In a preferred embodiment, the power tool further comprises a plurality of internal guide rails on which the transmission housing is slidably mounted.

The power tool may further comprise biasing means for damping vibrations of the transmission mechanism transmitted to the outer housing.

In a preferred embodiment, said biasing means comprises at least one coil spring.

In a preferred embodiment, the power tool is a hammer drill.

BRIEF DESCRIPTION OF THE DRAWINGS

Preferred embodiment of the present invention will now be described by way of example only and not in any limitative sense, with reference to the accompanying drawings in which:

FIG. 15*c* is a perspective view of the inside of the clamshell half of FIG. 15*a;*

DETAILED DESCRIPTION OF THE INVENTION

Figure 1:
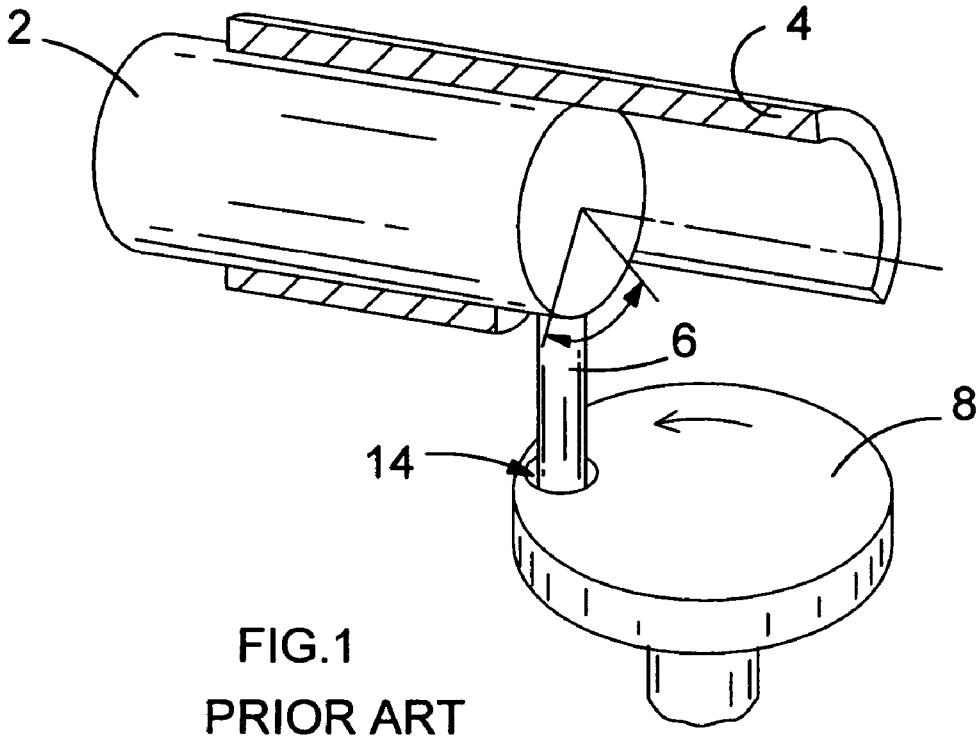
FIG.1 PRIOR ART
FIG. 1 is a partially cut away perspective view of a prior art drive mechanism for a hammer drill.
Figure 2:
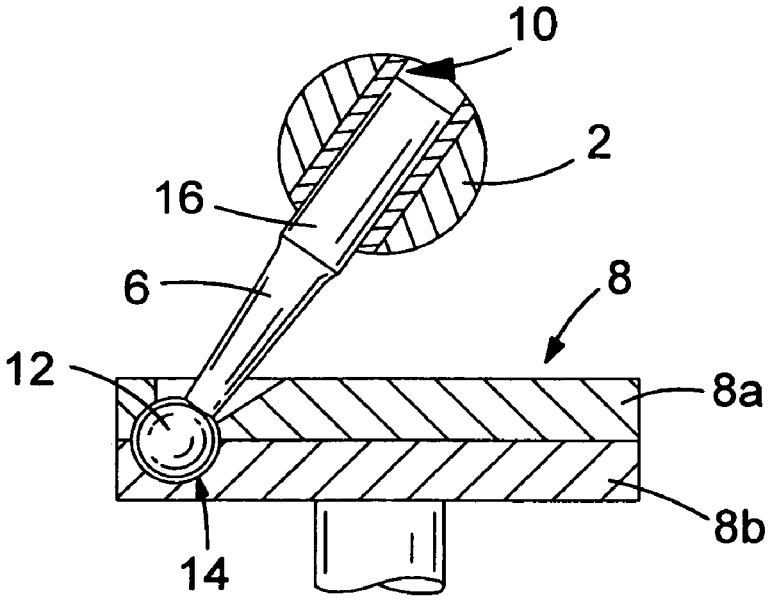
FIG.2 PRIOR ART
FIG. 2 is a cross-sectional view of the drive mechanism of FIG. 1.
Figure 3:
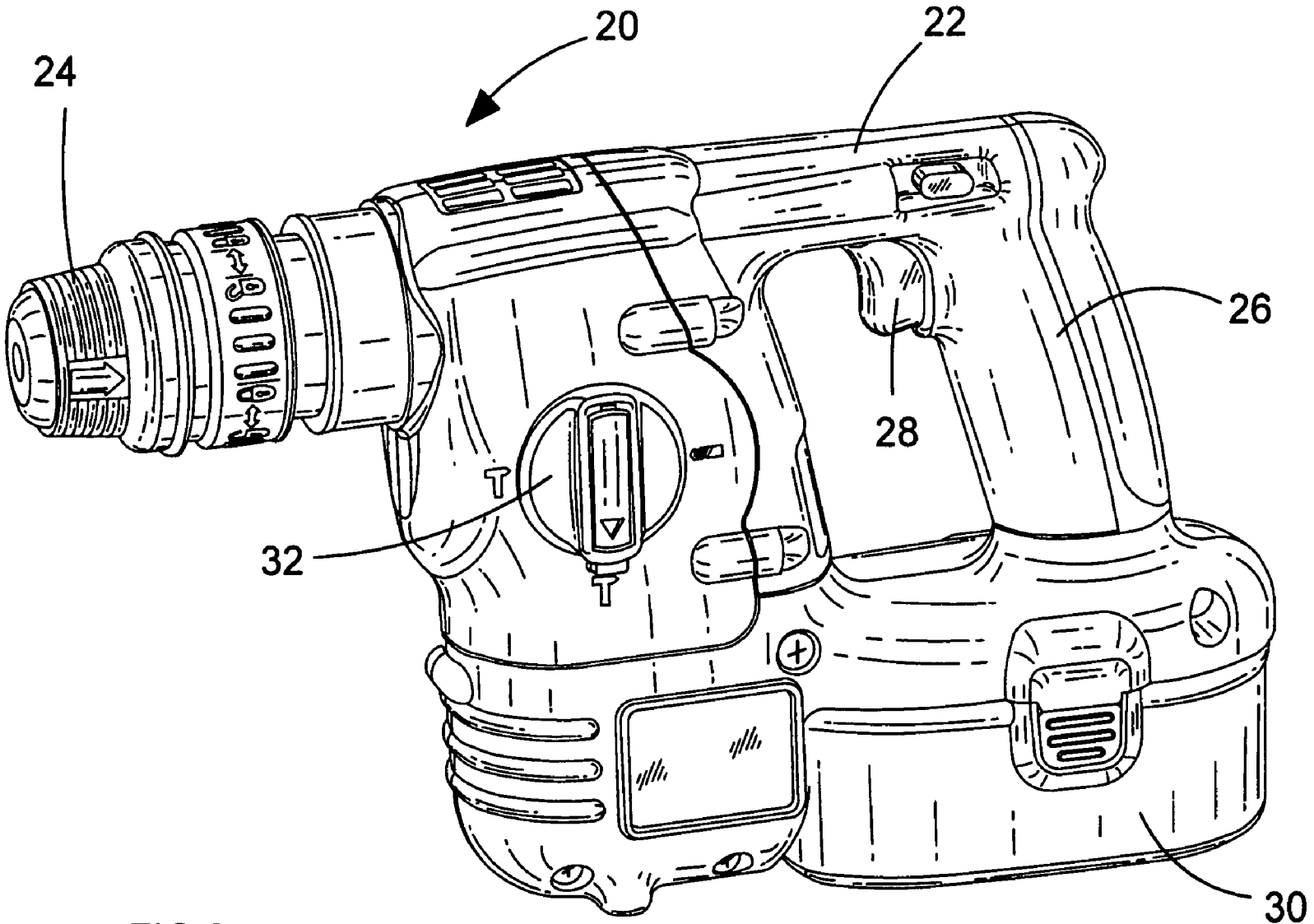
FIG. 3 is a perspective view of a hammer drill of a first embodiment of the present invention.

Referring to FIG. 3, a battery-powered hammer drill comprises a tool housing 22 and a chuck 24 for holding a drill bit (not shown). The tool housing 22 forms a handle 26 having a trigger 28 for activating the hammer drill 20. A battery pack 30 is releasably attached to the bottom of the tool housing 22. A mode selector knob 32 is provided for selecting between a hammer only mode, a rotary only mode and a combined hammer and rotary mode of operation of the drill bit.

Figure 4:
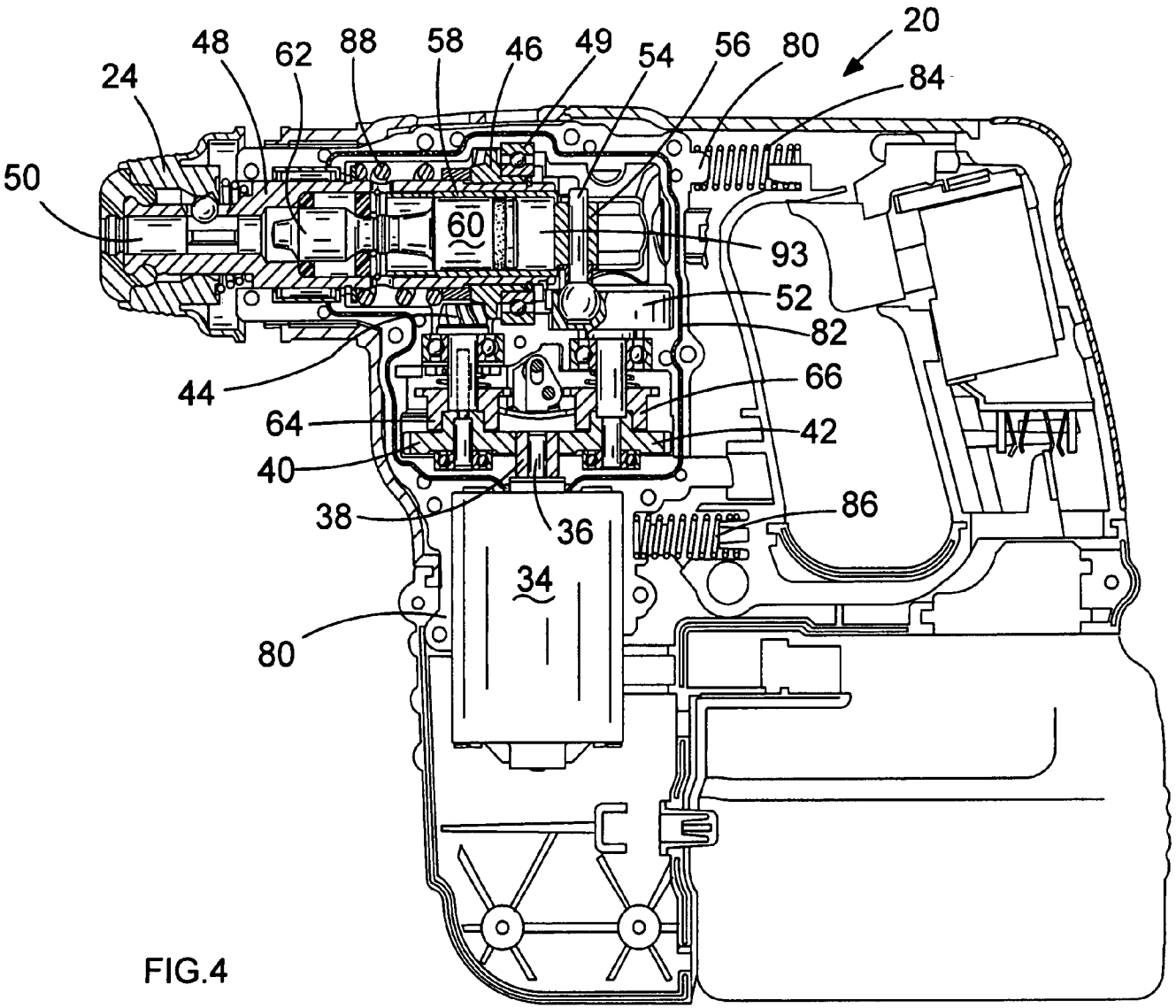
FIG. 4 is a side cross-sectional view of the hammer drill of FIG. 3.

Referring to FIG. 4, an electric motor 34 is provided in the tool housing 22 and has a rotary output shaft 36. A pinion 38 is formed on the end of output shaft 36, the pinion 38 meshing with a first drive gear 40 of a rotary drive mechanism and a second drive gear 42 of a hammer drive mechanism.

The rotary drive mechanism shall be described as follows. A first bevel gear 44 is driven by the first drive gear 40. The first bevel gear 44 meshes with a second bevel gear 46. The second bevel gear 46 is mounted on a spindle 48. Rotation of the second bevel gear 46 is transmitted to the spindle 48 via a clutch mechanism including an overload spring 88. The spindle 48 is mounted for rotation about its longitudinal axis by a spherical ball bearing race 49. A drill bit (not shown) can be inserted into the chuck 24 and connected to the forward end 50 of spindle 48. The spindle 48 and the drill bit rotate when the hammer drill 20 is in a rotary mode or in a combined hammer and rotary mode. The clutch mechanism prevents excessive torques being transmitted from the drill bit and the spindle 48 to the motor 34.

The hammer drive mechanism shall now be described as follows. The pinion 38 of motor output shaft 36 meshes with a second drive gear 42 such that rotation of the second drive gear 42 causes rotation of a crank plate 52. A crank pin 54 is driven by the crank plate 52 and slidably engages a cylindrical bearing 56 disposed on the end of a hollow piston 58. The hollow piston 58 is slidably mounted in the spindle 48 such that rotation of the crank plate 52 causes reciprocation of hollow piston 58 in the spindle 48. A ram 60 is slidably disposed inside hollow piston 58. Reciprocation of the hollow piston 58 causes the ram 60 to reciprocate with the hollow piston 58 as a result of expansion and contraction of an air cushion 93, as will be familiar to persons skilled in the art. Reciprocation of the ram 60 causes the ram 60 to impact a beat piece 62 which in turn transfers impacts to the drill bit (not shown) in the chuck 24 when the hammer drill operating in a hammer mode or a in combined hammer and rotary mode.

A mode change mechanism includes a first and a second drive sleeves 64, 66 which selectively couple the first and second drive gears 40, 42 respectively, to the first bevel gear 44 and the crank plate 52, respectively, in order to allow a user to select between either the hammer only mode, the rotary only mode or the combined hammer and rotary mode. The mode change mechanism is the subject of UK patent application no. 0428215.8.

A transmission mechanism comprises the rotary drive mechanism, the hammer drive mechanism and the mode change mechanism. The transmission mechanism is disposed inside a transmission housing 80. The transmission housing 80 also supports the electric motor 34. The transmission housing is formed from two clamshell halves of durable plastics material or cast metal, the two clamshell halves compressing an o-ring 82 therebetween. The o-ring 82 seals the transmission housing 80 to prevent dust and dirt from entering the transmission housing and damaging the moving parts of the transmission mechanism.

The transmission housing 80 is slidably mounted inside the tool housing 22 on parallel rails (not shown) and is supported against to the tool housing 22 by first and second damping springs 84 and 86 disposed at its rearward end. The transmission housing 80 can therefore move by a small amount relative to tool housing 22 in order to reduce transmission of vibration to the user during operation of the hammer drill 20. The spring co-efficients of the first and second damping springs 84 and 86 are chosen so that the transmission housing 80 slides to a point generally mid-way between its limits of forward and rearward travel when the hammer drill 20 is used in normal operating conditions. This is a point of equilibrium where the forward bias of the damping springs 84 and 86 equals the rearward force on the transmission housing 80 caused by the user placing the hammer drill 20 against a workpiece and leaning against the tool housing 22.

Figure 5:
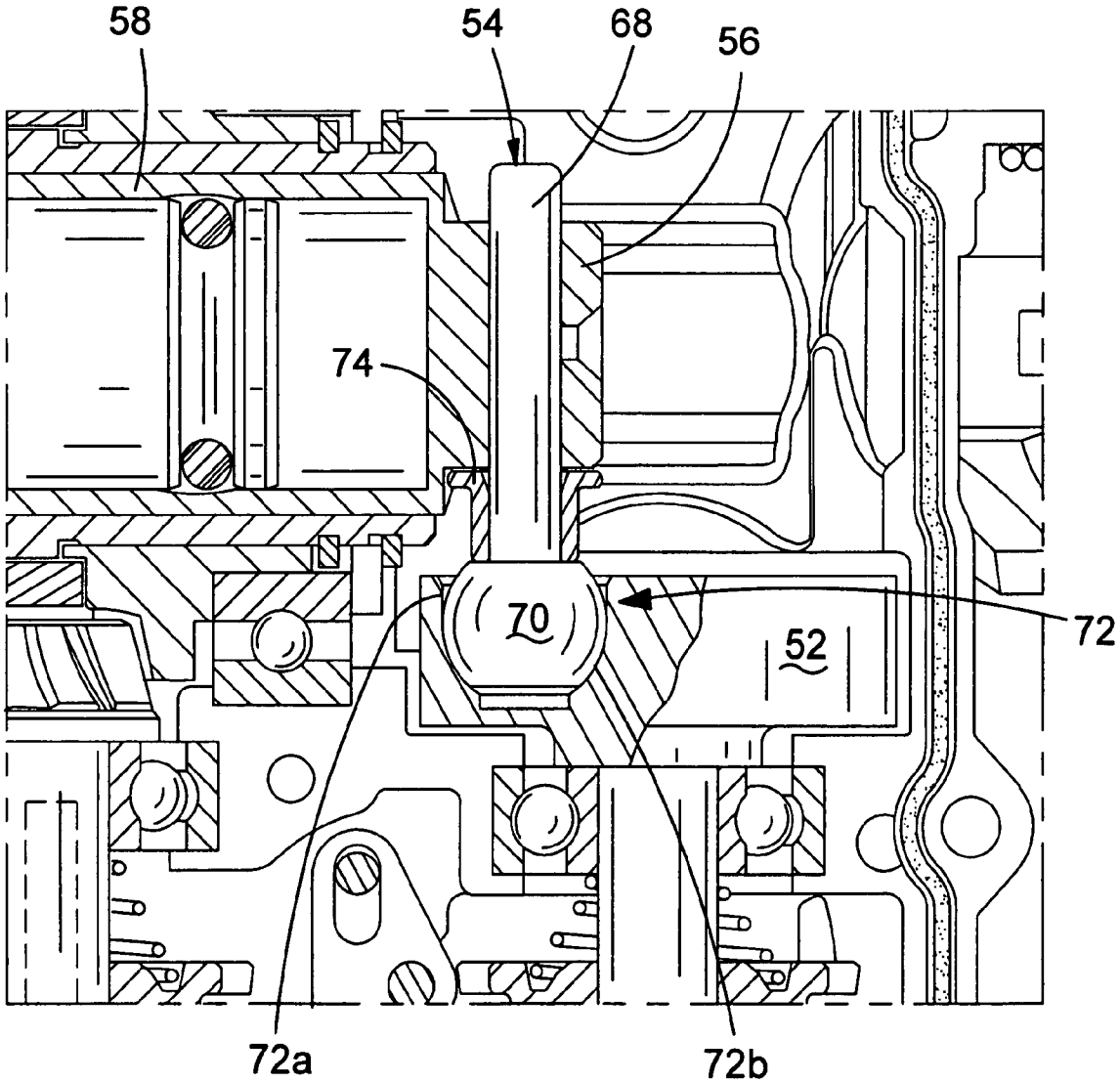
FIG. 5 is an enlarged side cross-sectional view of part of the hammer drill of FIG. 4.

Referring to FIG. 5, the hammer drive mechanism will be described in more detail. The crank pin 54 comprises a cylindrical link member 68 rigidly connected to a part-spherical bearing 70. The part-spherical bearing 70 is slidably and rotatably disposed in a cup-shaped recess 72 formed in the crank plate 52. The cup-shaped recess 72 has an upper cylindrical portion 72*a* and a lower generally semi-spherical portion 72*b*. The upper cylindrical portion 72*a* and a lower semi-spherical portion 72*b* have the same maximum diameter which is slightly greater than that of the part-spherical bearing 70. As a result, the part-spherical bearing 70 can be easily inserted into the cup-shaped recess. The crank pin 4 can pivot, rotate and slide vertically relative to the crank plate whilst the part-spherical bearing remains within the confines of the cup-shaped recess 72.

The cylindrical link member 68 is slidably disposed in a cylindrical bearing 56 formed in the end of the hollow piston 58. Sliding friction in the cup-shaped recess 72 is slightly greater than in the cylindrical bearing 56. The cylindrical link member 68 therefore slides up and down in the cylindrical bearing 56 while the part-spherical bearing rocks back and forth in the cup-shaped recess. A cylindrical collar member 74 surrounds the cylindrical link member 68 of the crank pin 54 and can slide between a lower position in which it abuts the upper surface of the part-spherical bearing 70 and an upper position in which it abuts and the underside of the cylindrical bearing 56. The collar member 74 is precautionary feature that limits movement of the part-spherical bearing 70 towards the cylindrical bearing 56 so that it is impossible for the crank pin 54 and its the part-spherical bearing 70 to move totally out of engagement with the cup-shaped recess 72. The cylindrical collar member 74 can be mounted to the crank pin 54 after construction of the crank plate 52 and crank pin 54 assembly.

Figure 6:
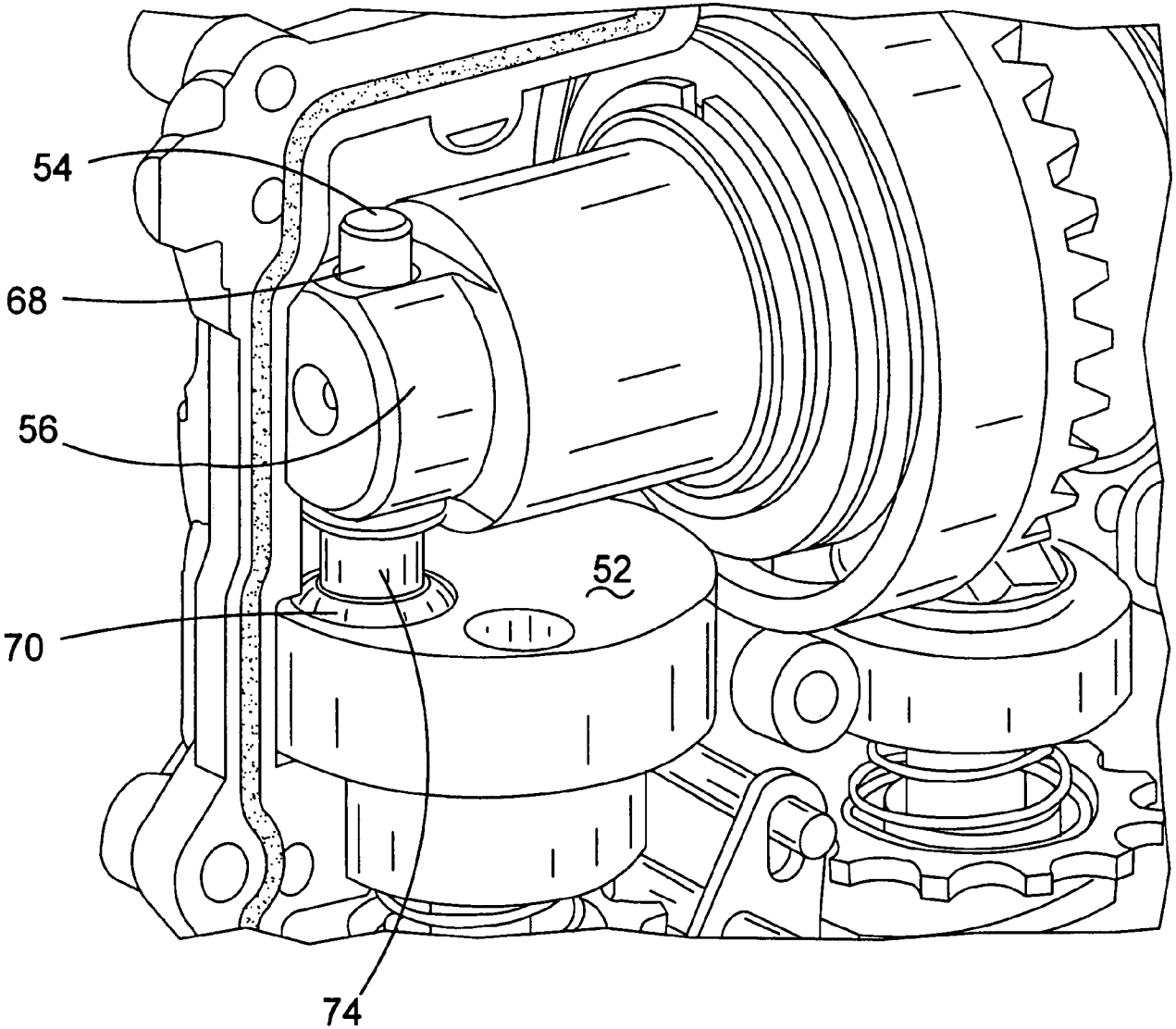
FIG. 6 is a partially cut away perspective view of part of the piston drive mechanism of FIG. 3 in its rearmost position.
Figure 7:
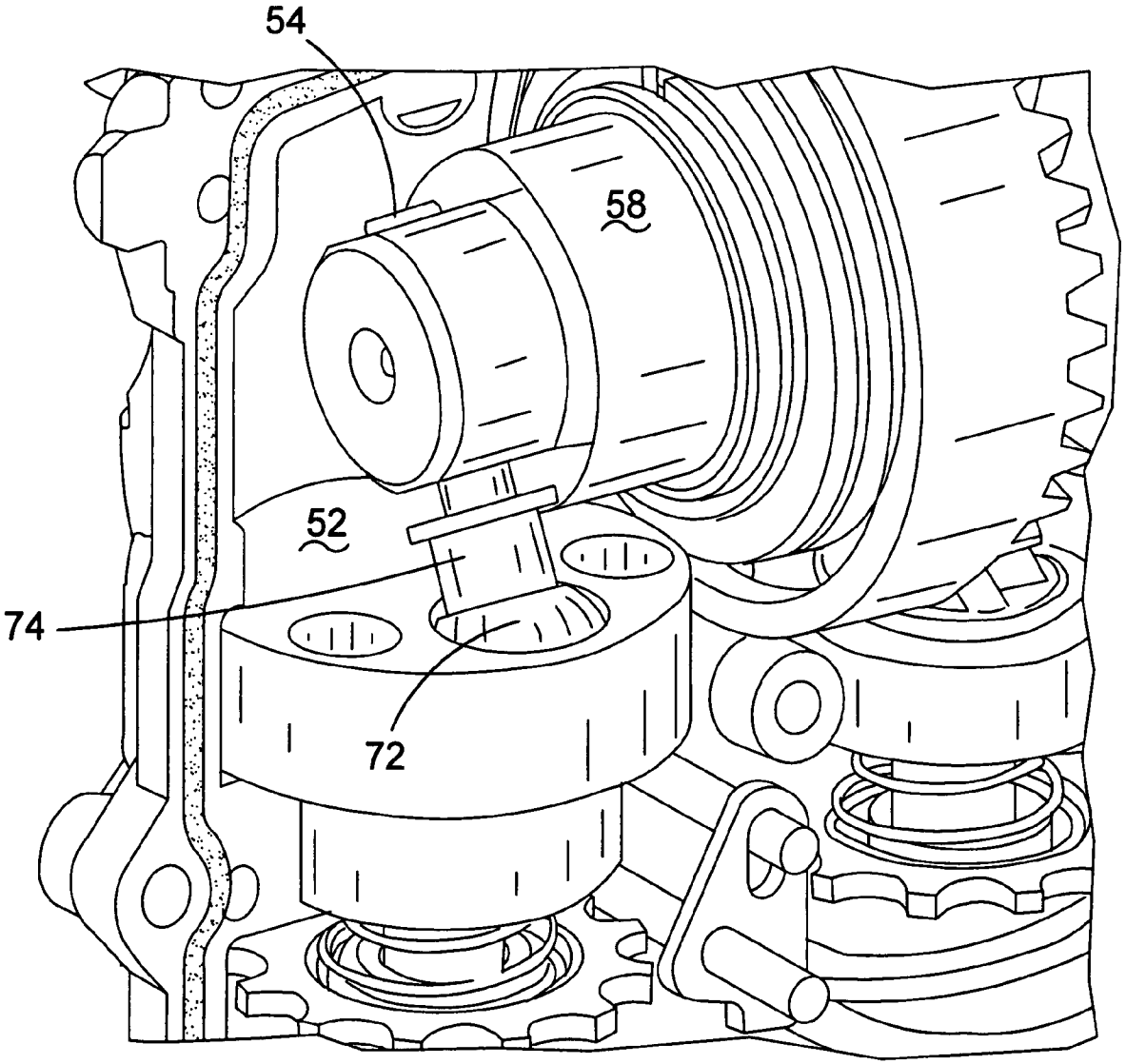
FIG. 7 is a partially cut away perspective view of part of the piston drive mechanism of FIG. 3 advanced through a quarter of a cycle of reciprocation from the position shown in FIG. 6.
Figure 8:
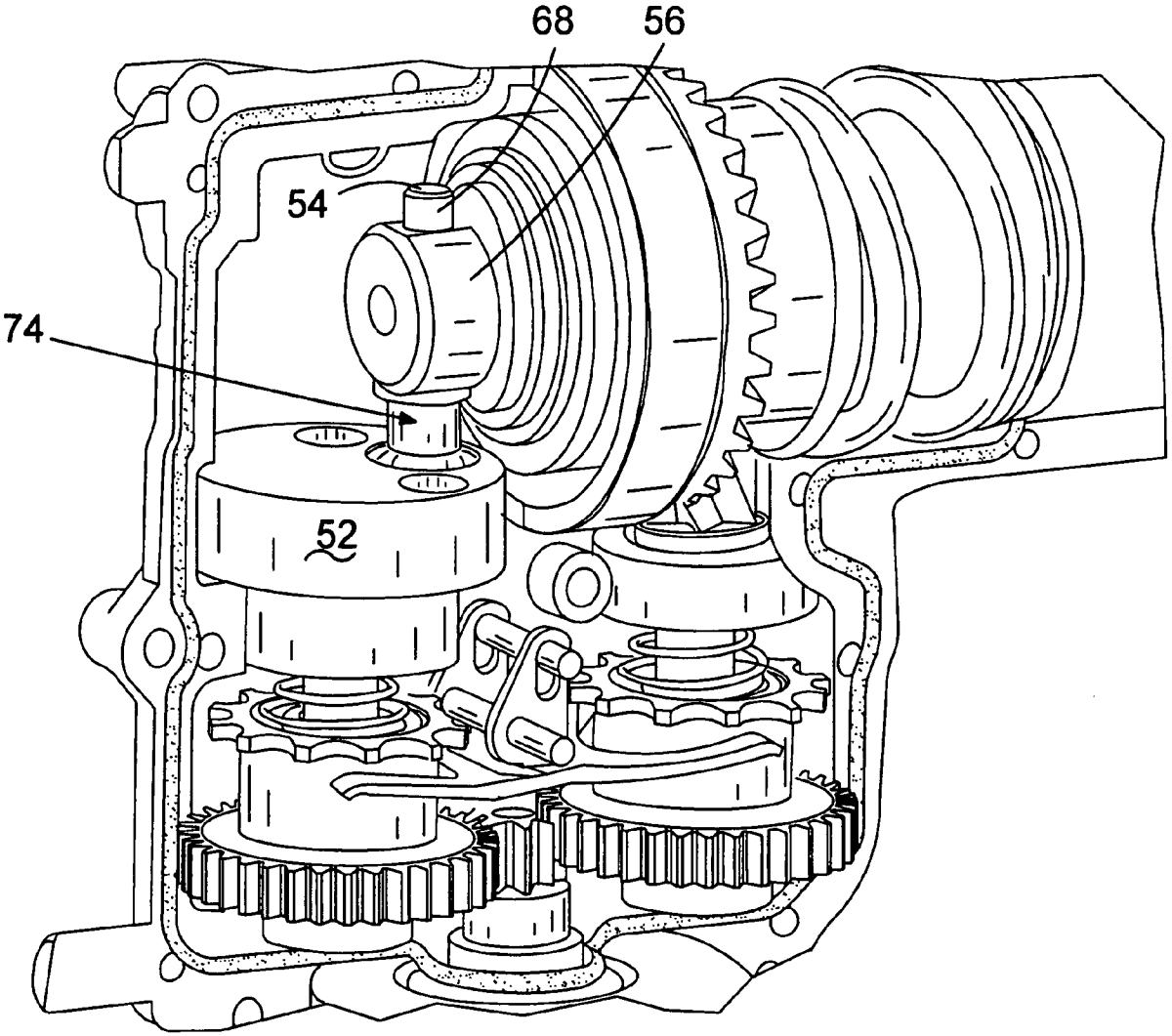
FIG. 8 is a partially cut away cross section of part of the piston drive mechanism of FIG. 3 advanced through half a cycle from the position shown in FIG. 6 to its foremost position.

Referring to FIGS. 6 to 8, as the crank plate 52 rotates in the anti-clockwise direction from the upright position shown in FIG. 6, to the position shown in FIG. 7, it can be seen that the crank pin 54 pushes the hollow piston 58 forwardly and also tilts to one side. As the crank pin 54 tilts, the cylindrical link member 68 slides downwardly in the cylindrical bearing 56. As the crank plate 52 rotates from the position of FIG. 7 to the position of FIG. 8 to push the hollow piston 58 to its foremost position, the crank pin 54 re-adopts an upright position and the cylindrical link member 68 of the crank pin 54 slides upwardly inside cylindrical bearing 56. It can be seen that by engagement of the collar member 74 with the underside of the cylindrical bearing 56 and the top of the part-spherical bearing 70, the crank pin 54 is prevented from moving too far inside the cylindrical bearing and out of engagement with the crank plate 52. There is therefore no need for an interference fit to trap the crank pin into engagement with the crank plate, which significantly simplifies assembly of the drive mechanism.

Figure 9:
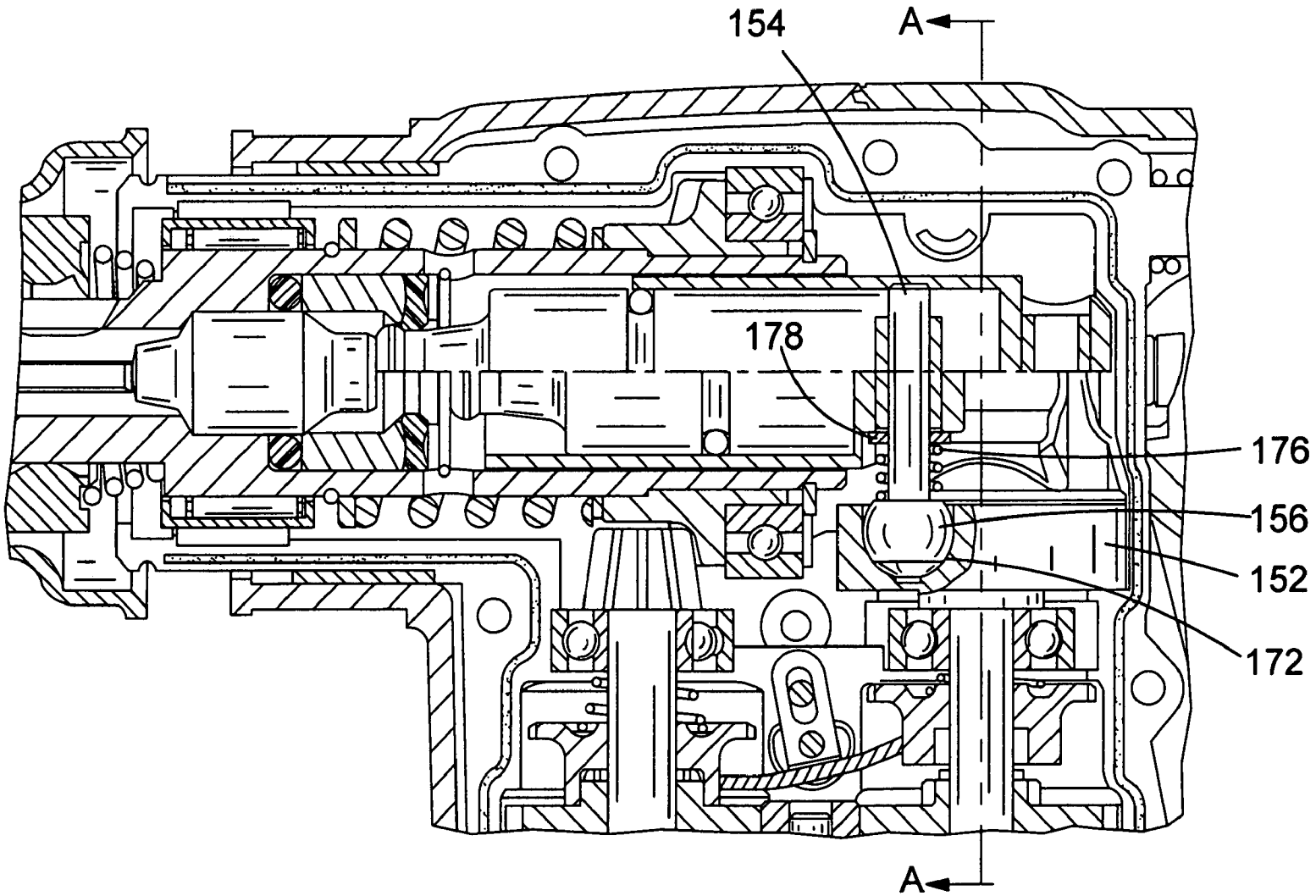
FIG. 9 is a side cross-sectional view of a piston drive mechanism for a hammer drill of a second embodiment of the present invention.
Figure 10:
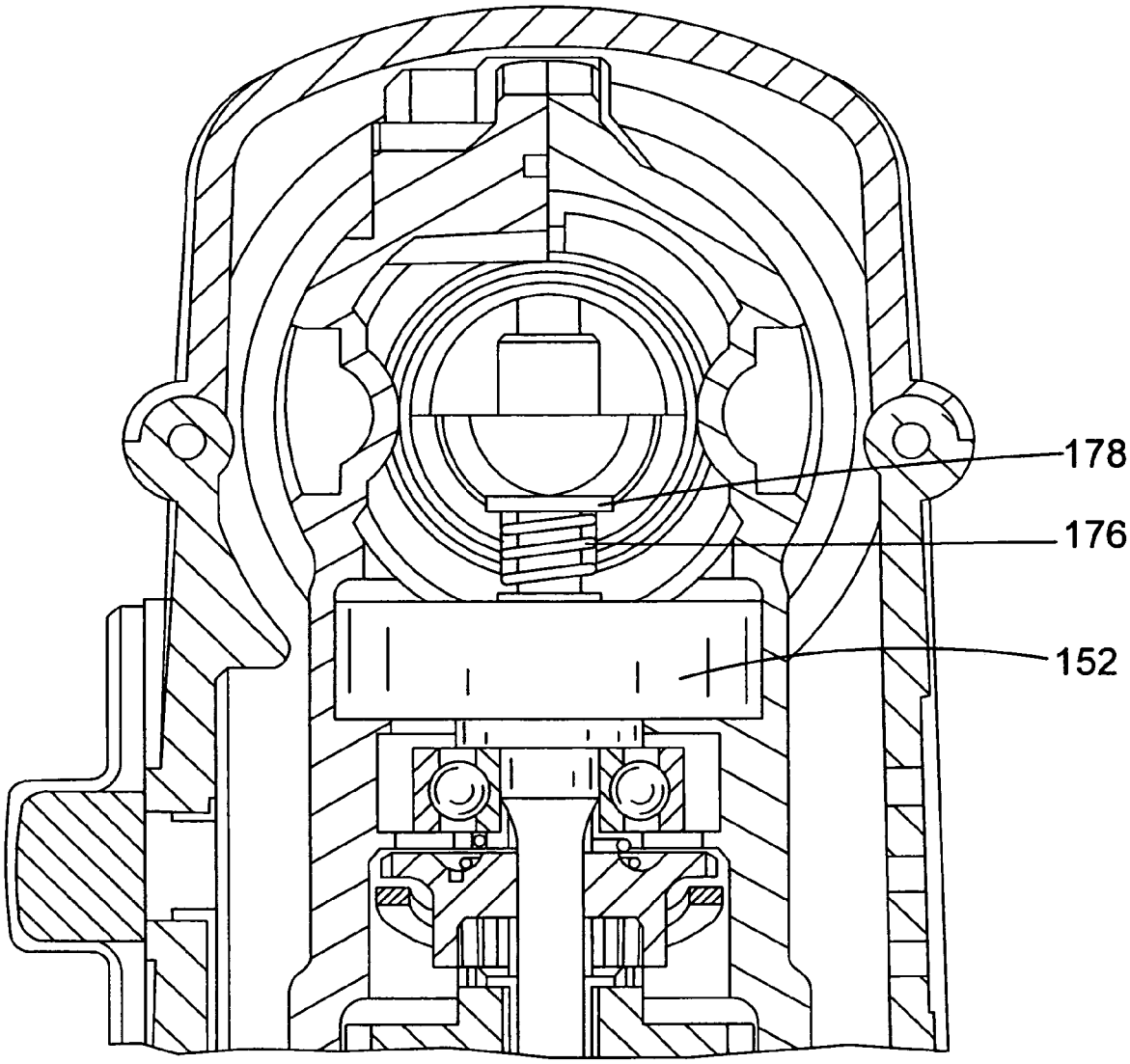
FIG. 10 is an enlarged cross-sectional view taken along line A-A of FIG. 9.

A hammer drill of a second embodiment of the invention is shown in FIGS. 9 and 10, with parts common to the embodiment of FIGS. 3 to 8 denoted by like reference numerals but increased by 100.

Crank pin 154 is of the same construction as the embodiment of FIGS. 3 to 8. However, in the embodiment of FIGS. 9 and 10 the collar member 176 is a coil spring. A washer 178 is provided between the collar coil spring 176 and the cylindrical bearing 156. The collar coil spring 176 has the further advantage of biasing the part-spherical bearing 170 of the crank pin 154 into engagement with the cup-shaped recess 172 of the crank plate 152 so that the part-spherical bearing is prevented from even partially moving out of engagement with the crank plate 152.

Figure 11:
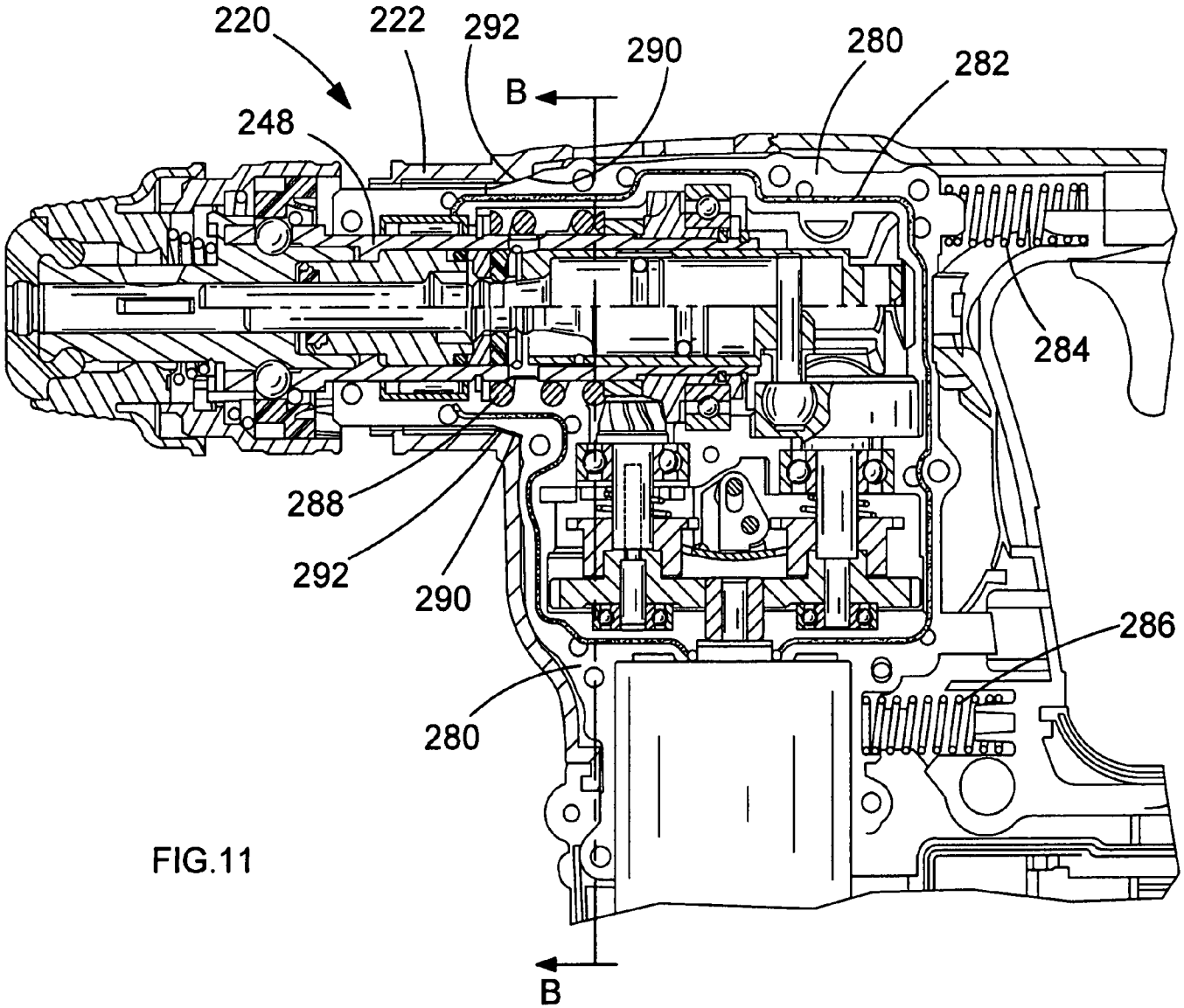
FIG. 11 is a side cross-sectional view of part of a hammer drill of a third embodiment of the present invention.
Figure 13:
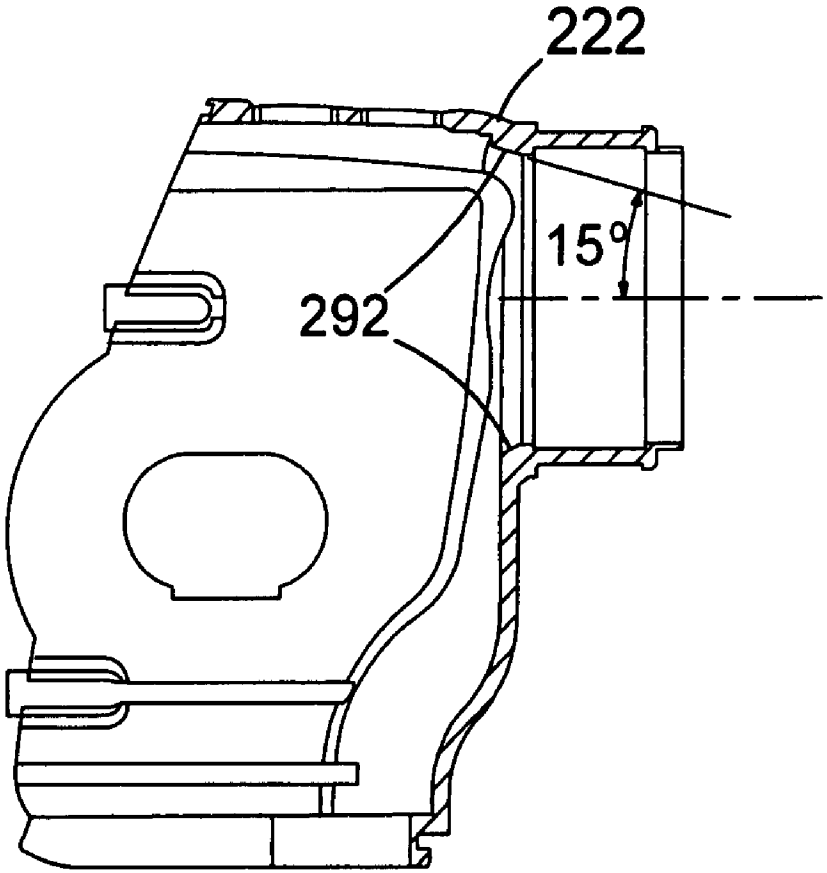
FIG. 13 is a cross section taken along line C-C of FIG. 12.
Figure 12:
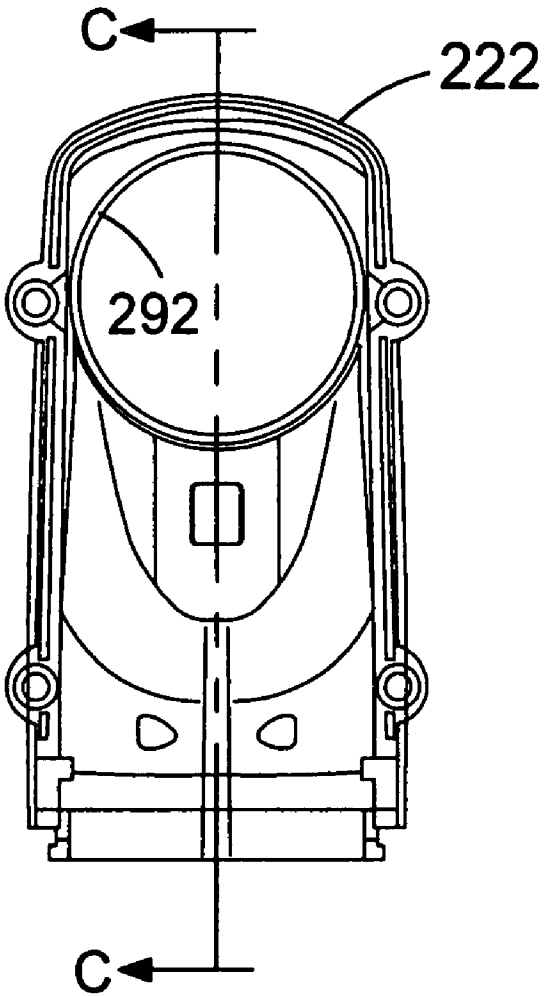
FIG. 12 is a cross-sectional view taken along line B-B of FIG. 11, with parts of the transmission mechanism removed for clarity.

A hammer drill of a third embodiment of the invention is shown in FIGS. 11 to 13, with parts common to the embodiment of FIGS. 3 to 8 denoted by like reference numerals but increased by 200.

The transmission housing 280 is formed from two clamshell halves of durable plastics or cast metal material. The two clamshell halves trap and compress an O-ring 282 therebetween. The transmission housing 280 is supported by first and second damping springs 284 and 286 at its rearward end. The transmission housing 280 is also mounted on parallel rails (not shown) disposed within the tool housing 222 such that the transmission housing 280 can slide a small distance relative to the tool housing 222 backwards and forwards in the direction of the longitudinal axis of the spindle 248.

The spring coefficients of damping springs 284 and 286 are chosen so that the transmission housing 280 slides to a point generally mid-way between its limits of forward and backward travel when the hammer drill is used in normal operating conditions. This is a point of equilibrium where the forward bias of the damping springs 284 and 286 equals the rearward force on the transmission housing 280 caused by the user placing the hammer drill 220 against a workpiece and leaning against the tool housing 222.

The forward end of the transmission housing 280 has a generally part-conical portion 290, which abuts a corresponding part-conical portion 292 formed on the tool housing 222. The part conical portions 290 and 292 form an angle of approximately 15° with the longitudinal axis of the spindle 248. The interface defined by the part-conical portions 290 and 292 defines a stop at which the transmission housing 280 rests against the tool housing 222 when the hammer drill 220 is in its inoperative condition. When the hammer drill 220 is being used in normal operating conditions, a gap opens up between the surfaces of the part-conical portions 290 and 292 which helps to damp axial and lateral vibrations that would otherwise be directly transmitted from the tool bit (not shown) to the user holding the hammer drill 220. Naturally, this gap slightly increases as the transmission housing moves backwards against the bias of the damping springs 282, 286. This helps to damp the increased axial and lateral vibrations which may arise when the user applies greater forward pressure to the hammer drill 220. However, the gap is sufficiently small that the hammer drill 220 and the transmission housing 280 can always be adequately controlled by the user via the interface between the part-conical portions 290, 292 which maintains alignment of the transmission housing 280 with the tool housing 222.

Figure 14:
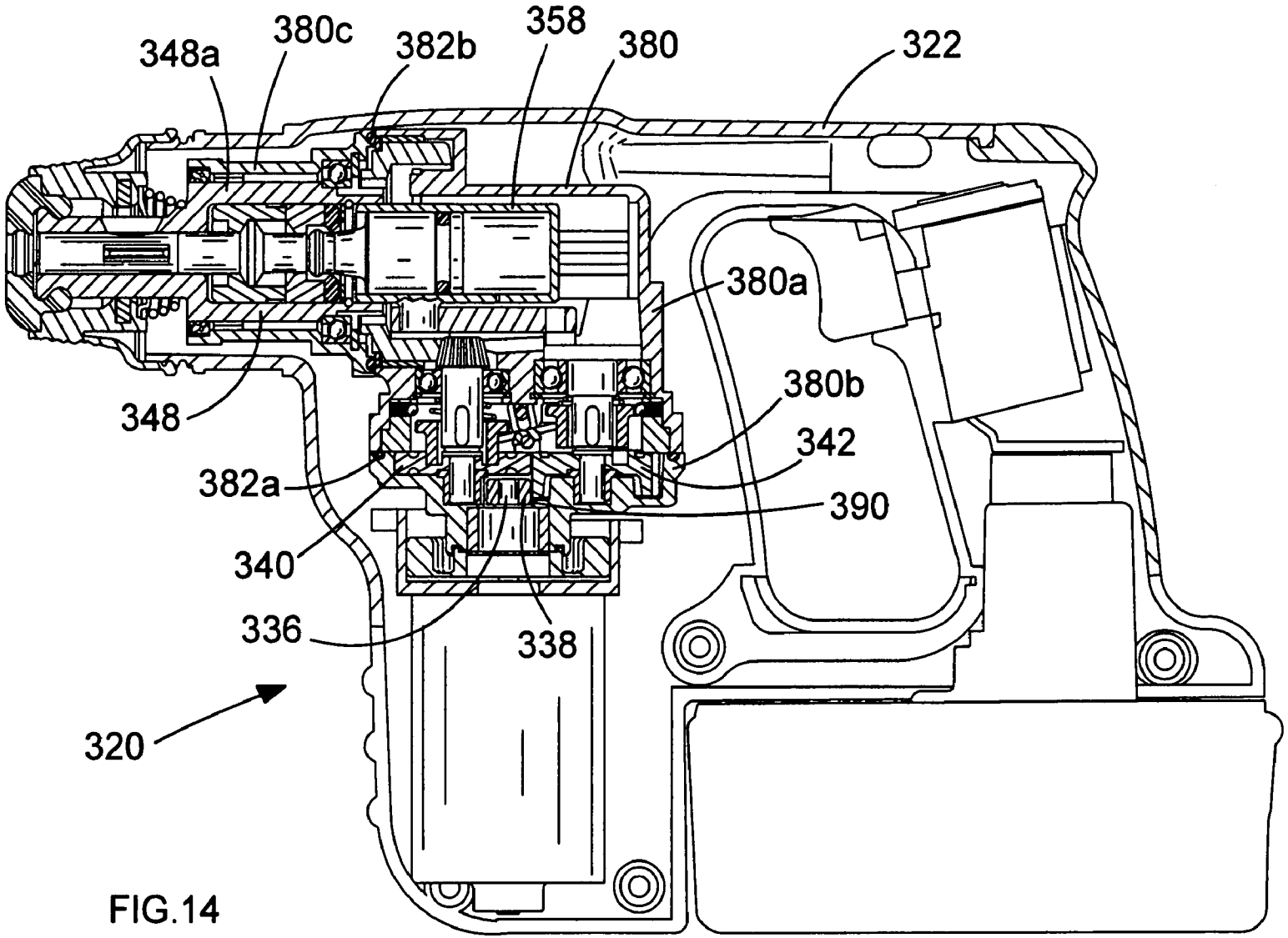
FIG. 14 is a side cross-sectional view of a hammer drill of a fourth embodiment of the present invention.
Figure 15A:
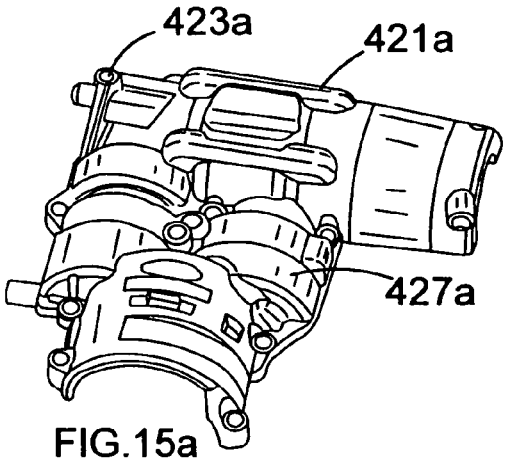
FIG. 15*a* is a perspective view from outside of a right clamshell half of a two part transmission housing of a hammer drill of a fifth embodiment of the present invention.
Figure 15B:
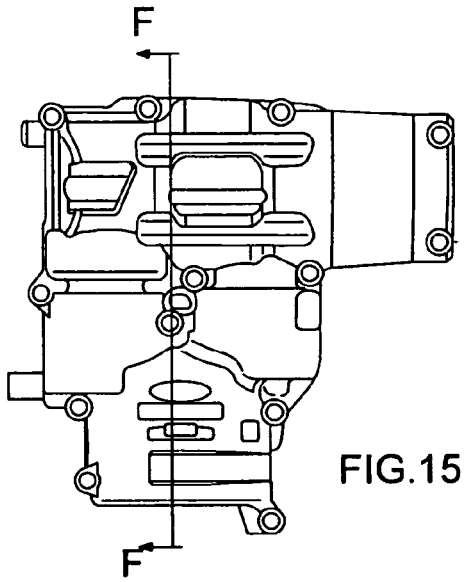
FIG. 15*b* is a side view of the outside of the clamshell half of FIG. 15*a;*
Figure 15D:
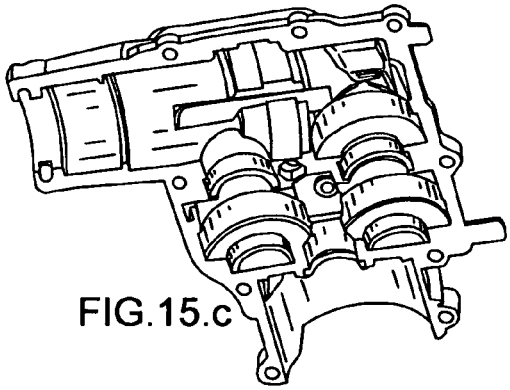
FIG. 15*d* is a side view of the inside of the clamshell half of FIG. 15*a;*
Figure 15D:
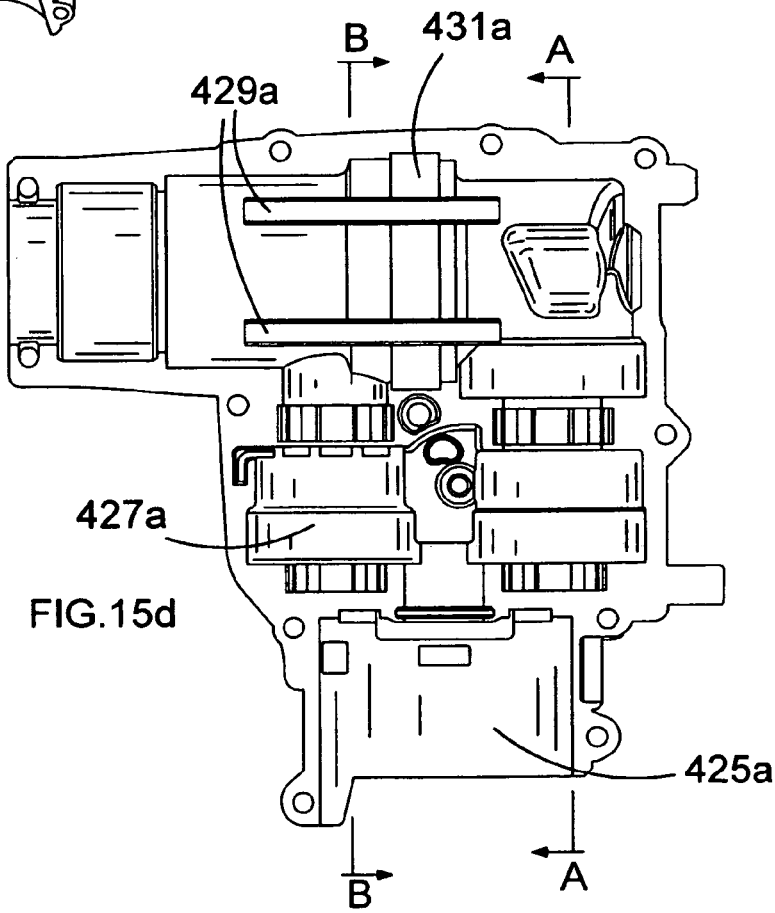
Figure 15E:
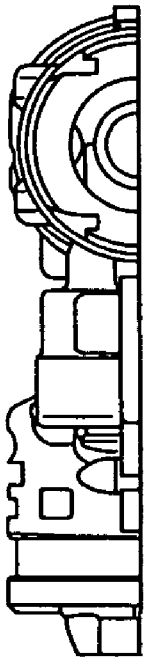
FIG. 15*e* is a front view of the clamshell half of FIG. 15*a;*
Figure 15F:
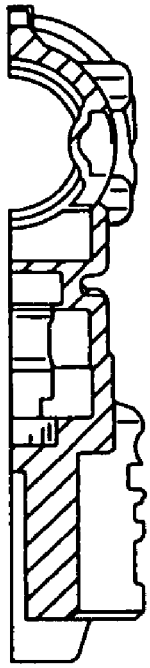
FIG. 15*f* is a cross-sectional view taken along line A-A of FIG. 15*d;*
Figure 15G:
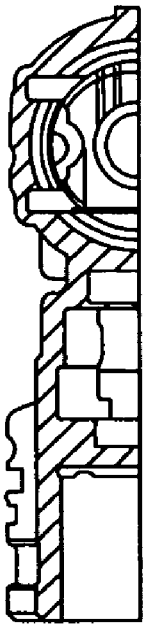
FIG. 15*g* is a cross-sectional view taken along line B-B of FIG. 15*d;*
Figure 15H:
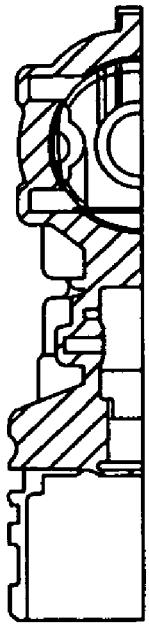
FIG. 15*h* is a cross-sectional view along line F-F of FIG. 15*b;*
Figure 16A:
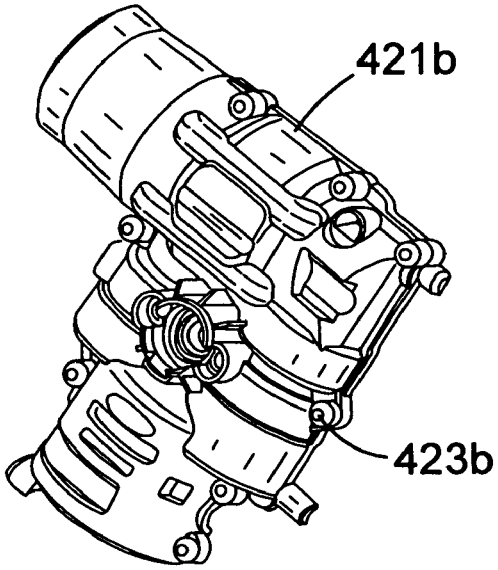
FIG. 16*a* is a perspective view from the outside of a left clamshell half corresponding to the right clamshell half of FIGS. 15*a* to 15*h;*
Figure 16B:
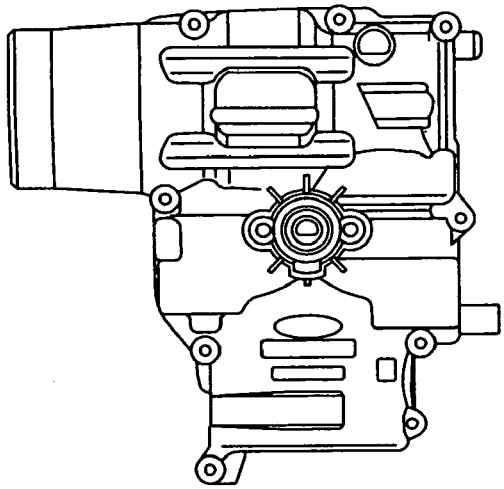
FIG. 16*b* is a side view of the outside of the clamshell half of FIG. 16*a;*
Figure 16C:
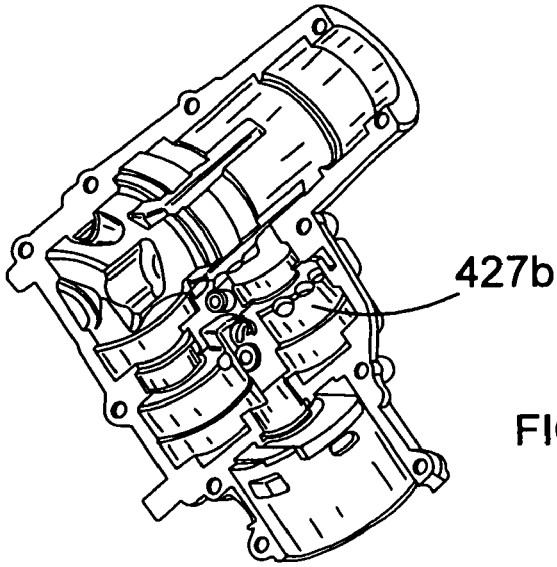
FIG. 16*c* is a perspective view of the inside of the clamshell half of FIG. 16*a;*
Figure 16D:
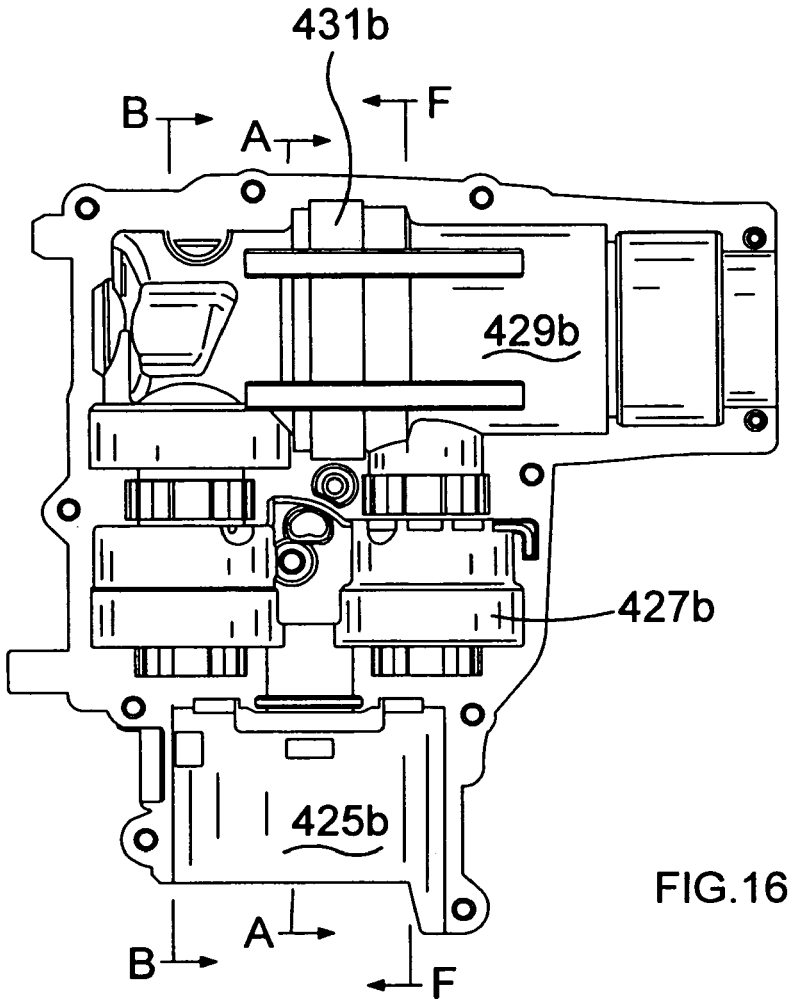
FIG. 16*d* is a side view of the inside of the clamshell half of FIG. 16*a;*
Figure 16E:
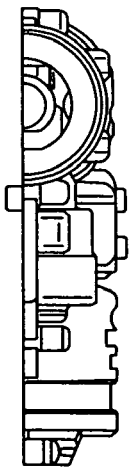
FIG. 16*e* is a front view of the clamshell half of FIG. 16*a;*
Figure 16F:
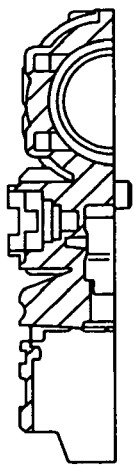
FIG. 16*f* is a cross-sectional view along line A-A of FIG. 16*d;*
Figure 16G:
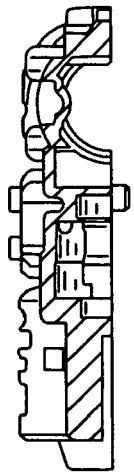
FIG. 16*g* is a cross-sectional view taken along line B-B of FIG. 16*d;*
Figure 16H:
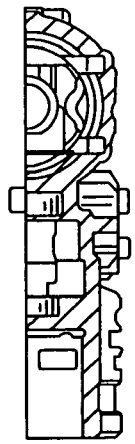
FIG. 16*h* is a cross-sectional view taken along line F-F of FIG. 16*d;*
Figure 17:
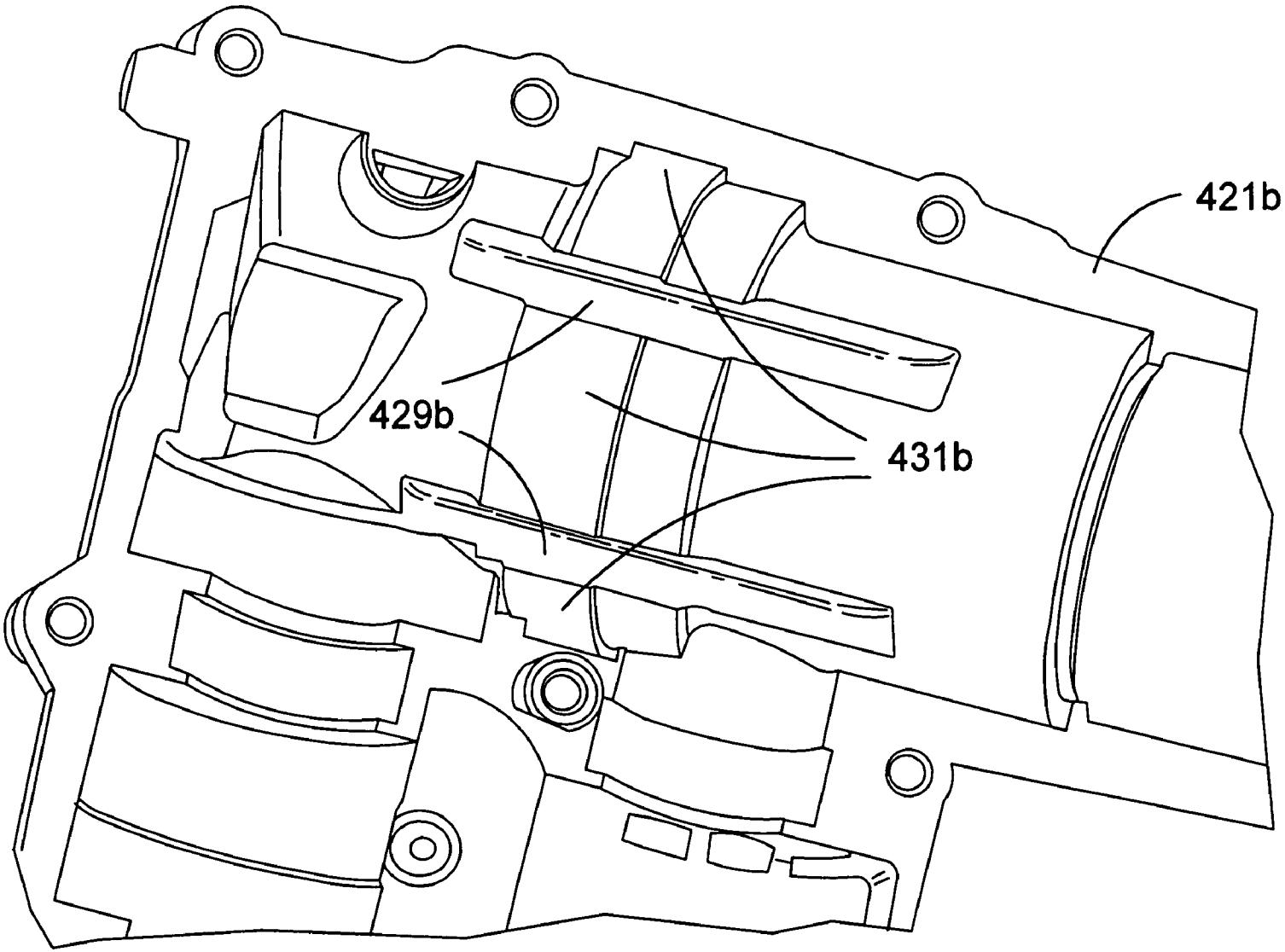
FIG. 17 is an enlarged perspective view of the inside of the clamshell half of FIG. 16.

A hammer drill of a fourth embodiment of the invention is shown in FIG. 14, with parts common to the embodiment of FIGS. 3 to 8 denoted by like reference numerals but increased by 300.

The hammer drill 320 has a tool housing 322. In this embodiment, the transmission housing 380 is formed from three housing portions. A generally L-shaped first housing portion 380*a* accommodates the transmission mechanism except for the first and second gears 340, 342 and the front end 348*a* of the spindle 348. The bottom end of the first housing portion 380*a* is mounted upon a second housing portion 380*b* such that a first O-ring 382*a* is trapped between the two portions to prevent the ingress of dust and dirt. The second housing portion 380*b* holds the lower parts of the transmission mechanism inside the first housing portion 380*a* and accommodates the first and second gears 340, 342. The second housing portion 380*b* has a motor output aperture 390 to allow the motor output shaft 336 access to the inside of the transmission housing and to enable the pinion 338 to drive the first and second gears 340, 342 of the transmission mechanism. A third housing portion 380*c* is mounted to the front end of the first housing portion 380*a* such that a second O-ring 382*b* is trapped between the two portions to prevent the ingress of dust and dirt. The third housing portion 380*c* holds the front parts of the transmission mechanism inside the first housing portion 380*a* and accommodates the front end 348*a* of the spindle.

The generally L-shaped first transmission housing portion 380*a* allows the transmission mechanism to be fully assembled inside the first transmission housing portion 380*a* from both its ends. For example, the hollow piston and spindle assemblies can be inserted into the front end of the first transmission housing portion 380*a*, and the first transmission housing portion 380*a* can then be turned through 90° and the various gears and mode change mechanism can be inserted through the bottom end and dropped into place to engage the spindle 348 and hollow piston 358. The second and third transmission housing portions 380*b* and 380*c* can then be mounted to the first transmission housing portion 380*a* in order to cap off the open ends of the first transmission housing portion 380*a*.

The first transmission housing portion 380*a* can be used as a standard platform (including standard hammer drive, rotary drive and mode change mechanisms) for several power tools, and the second and third transmission housing portions 380*b* and 380*c* changed to accommodate motors and spindles of differing sizes.

A hammer drill of a fifth embodiment of the invention has a transmission housing shown in FIGS. 15 to 20, with parts common to the embodiment of FIGS. 3 to 8 denoted by like reference numerals but increased by 400.

Referring to FIGS. 15 and 16, a transmission housing is formed from a right clamshell half 421*a* and a left clamshell half 421*b* formed from injection moulded high-grade strong plastics material. The clamshell halves 421*a*, 421*b* each have a plurality of threaded holes 423*a*, 423*b* respectively adapted to receive screws (not shown) such that the clamshell halves 421*a*, 421*b* can be joined together to form the transmission housing which encapsulates the transmission mechanism.

The two-part transmission housing is adapted to hold all the components of the transmission mechanism. Various indentations are moulded in the clamshell halves to provide support for these components. For example, first drive gear indentations 427*a* and 427*b* are shaped to support the first drive gear 40. A motor support portion 425*a* and 425*b* is adapted to support and partially encapsulate the top part of the electric motor 34.

The transmission housing is slidably mounted on a pair of guide rails (not shown) in the tool housing 22. As the transmission housing is disposed inside of the tool housing 22 and out of sight of the user, high-grade strong plastics material can be used in the construction of the transmission housing. This type of material is normally not suitable for external use on a power tool due to its unattractive colour and texture. High-grade strong plastics material also generally has better vibration and noise damping properties than metal. Strengthening ribs (not shown) can also be moulded into the plastics material to increase the strength of the transmission housing.

Referring to FIGS. 15 to 20, each of the clamshell halves 421*a* and 421*b* includes integrally formed overflow channels 429*a* and 429*b*. The clamshell halves also include respective ball bearing race support recesses 431*a* and 431*b* which are adapted to hold the ball bearing race 49 to support the spindle 48.

Figure 18:
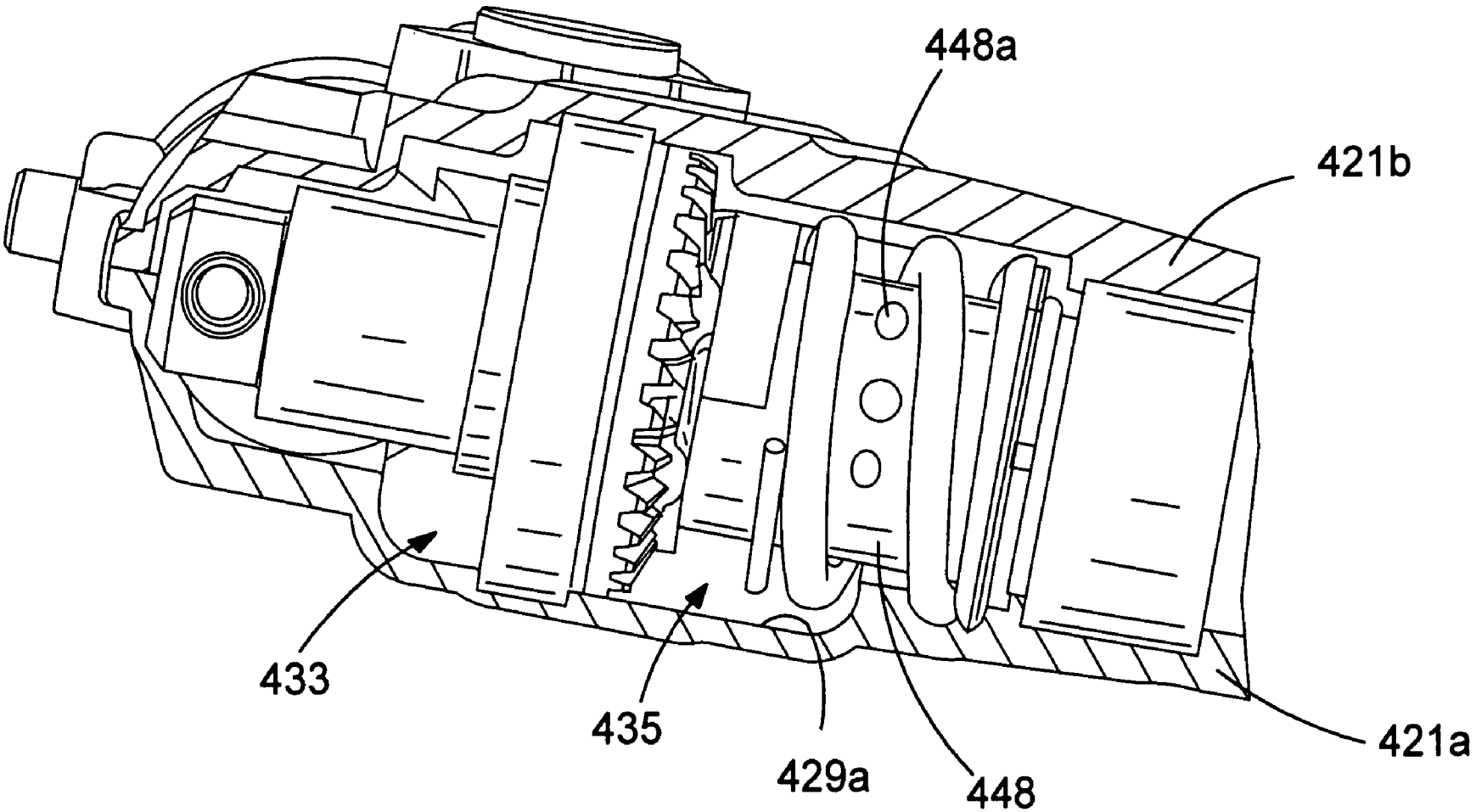
FIG. 18 is a partially cut away top view of part of a hammer drill incorporating the clamshell halves of FIGS. 15 and 16.
Figure 19:
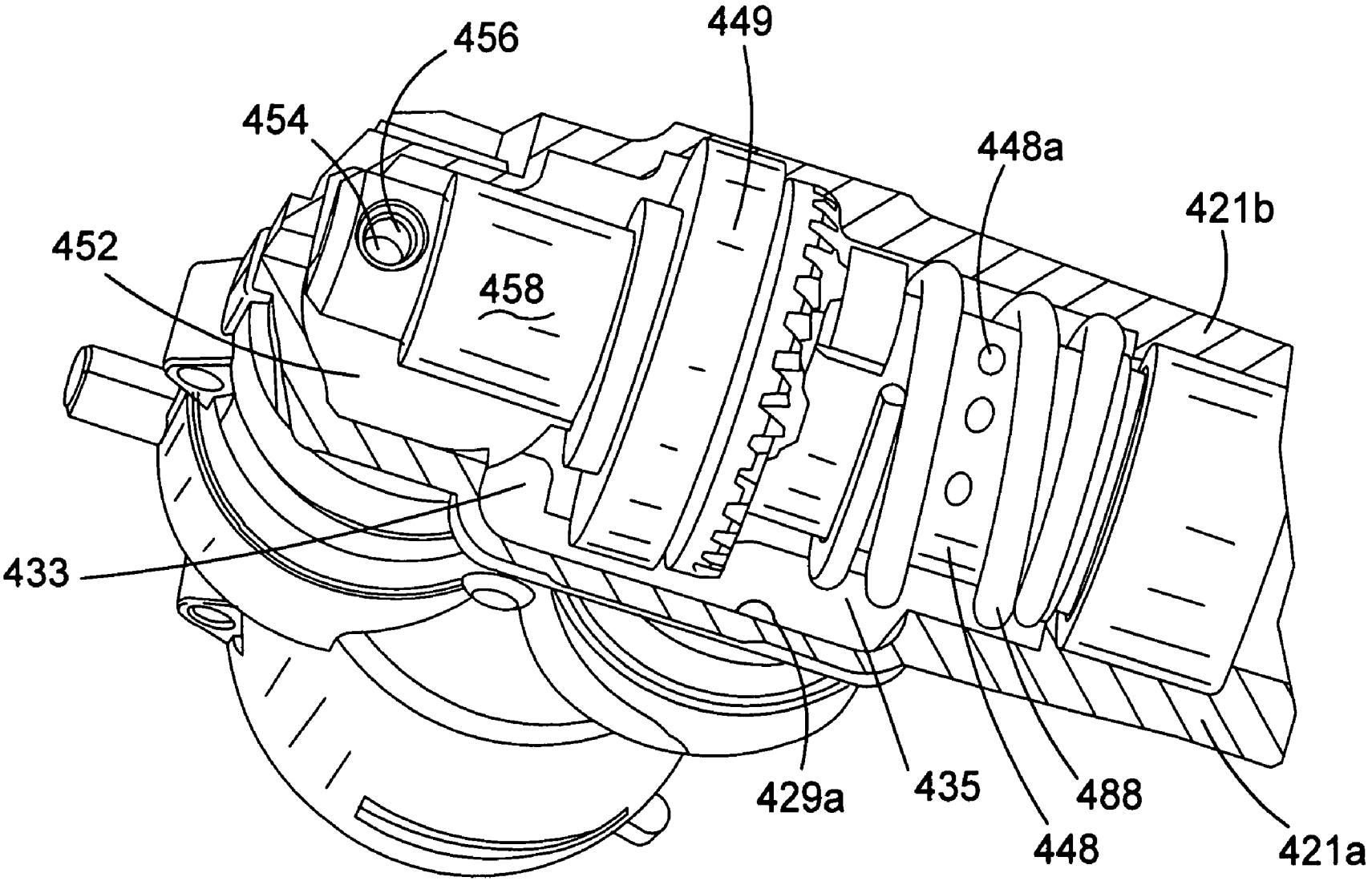
FIG. 19 is a partially cut away perspective view of part of the hammer drill of FIG. 18.
Figure 20:
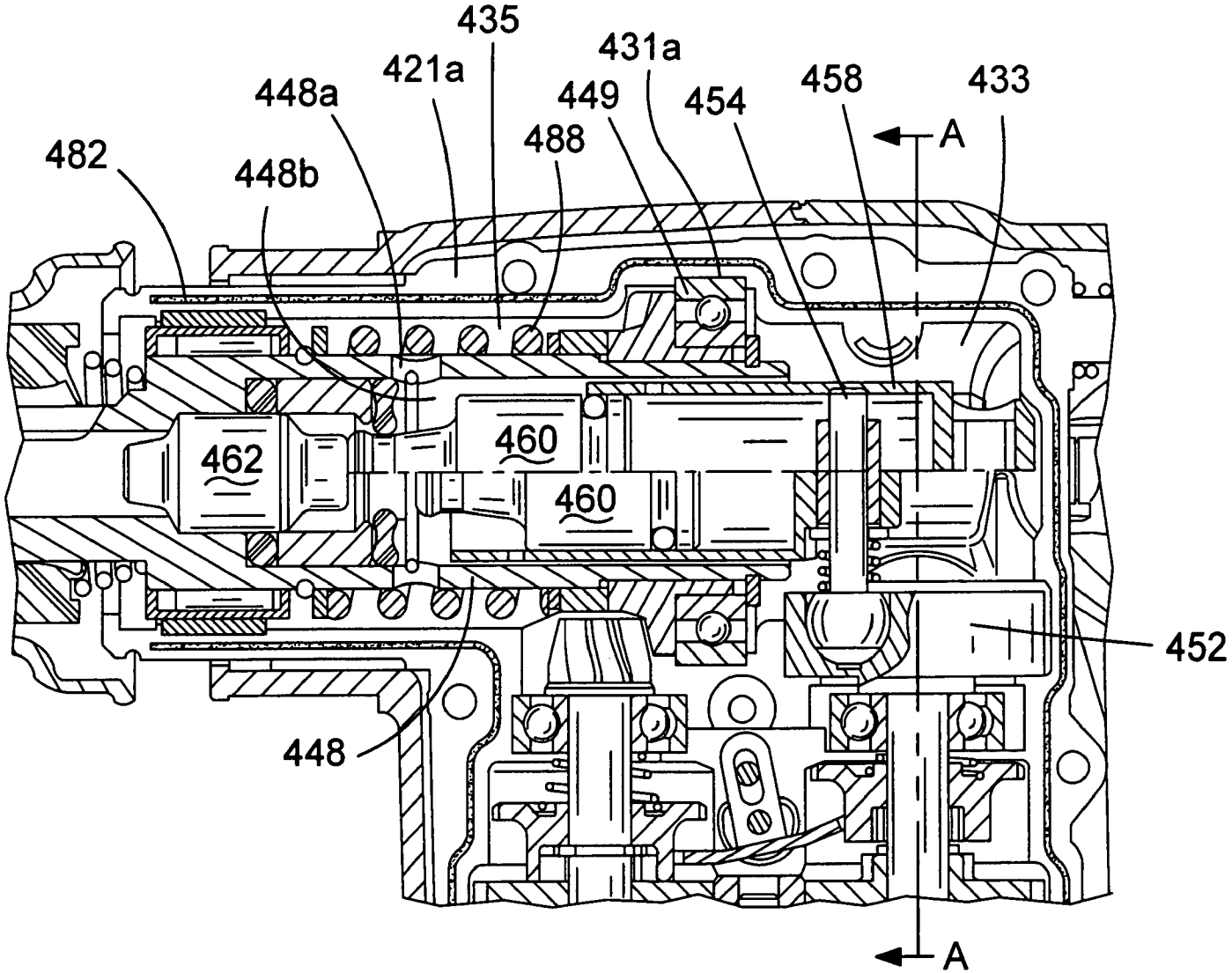
FIG. 20 is another side cross-sectional view of the piston drive mechanism.
Figure 21:
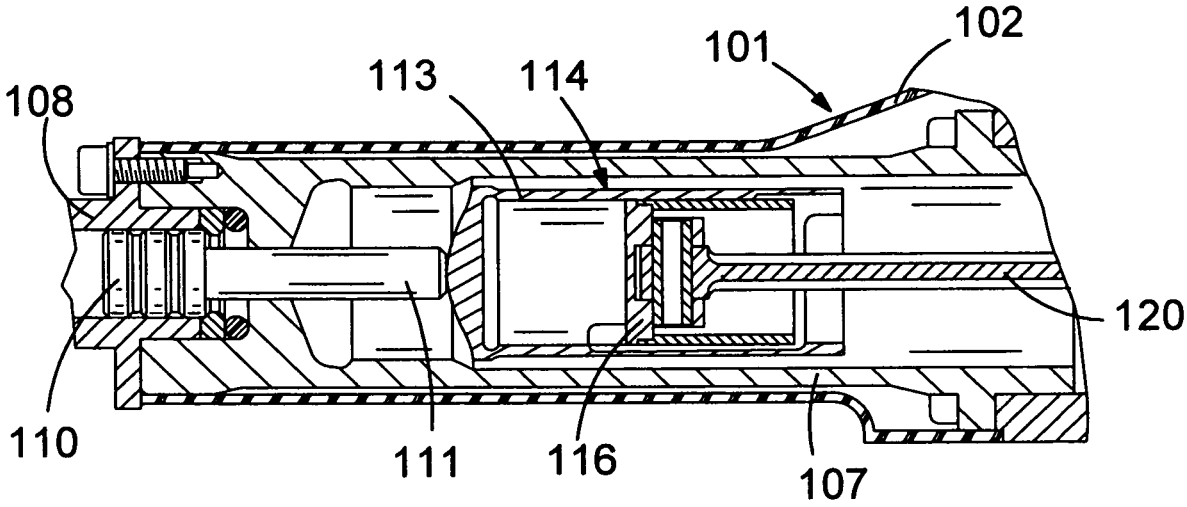
FIG.21 PRIOR ART
FIG. 21 is a cross-sectional view of a prior art piston drive mechanism.
Figure 22:
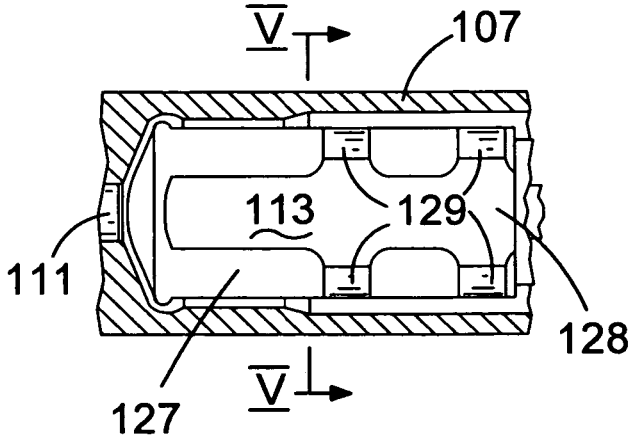
FIG.22 PRIOR ART
FIG. 22 is an enlarged partial cross-sectional view of the piston drive mechanism of FIG. 21.
Figure 23:
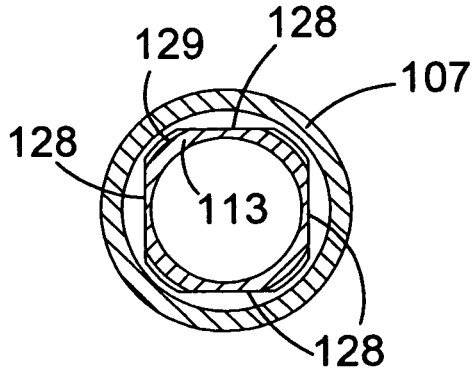
FIG.23 PRIOR ART
FIG. 23 is a cross-sectional view along line V-V of FIG. 22.
Figure 24A:
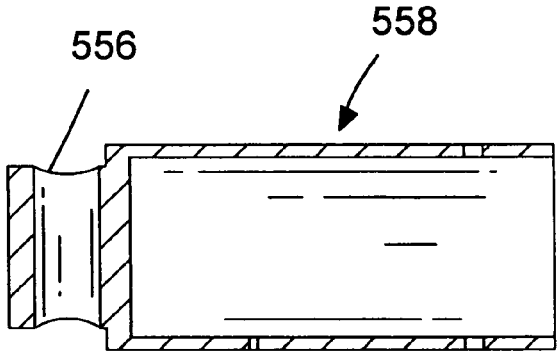
FIG. 24*a* is a cross-sectional view of a hollow piston of a hammer drill of a sixth embodiment of the present invention.
Figure 24B:
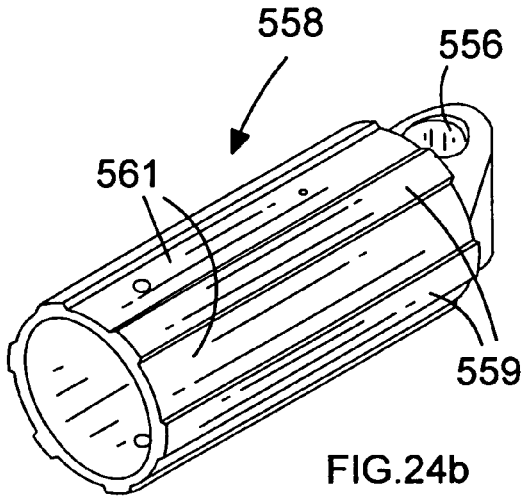
FIG. 24*b* is a perspective view from the side of the hollow piston of FIG. 24*a;*
Figure 24C:
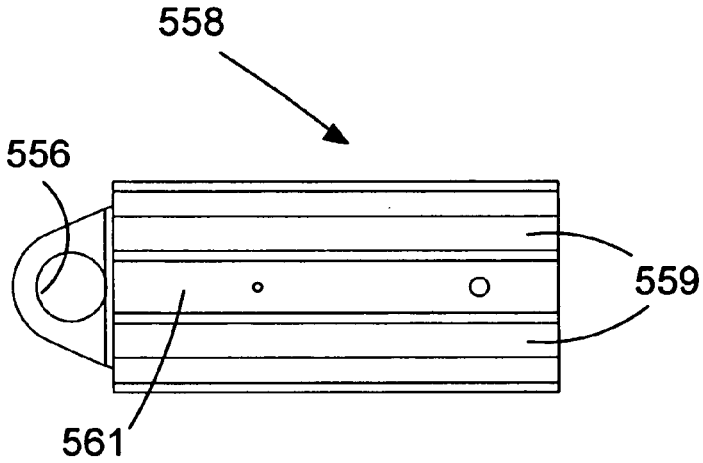
FIG. 24*c* is a top view of the hollow piston of FIG. 24*a;*
Figure 24D:
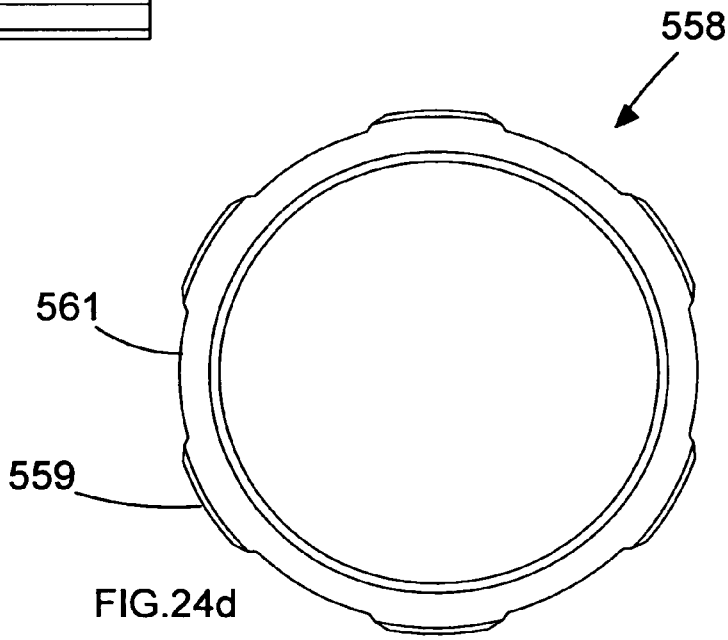
FIG. 24*d* is a view from the front of the hollow piston of FIG. 24*a;*

Referring in particular to FIGS. 18 to 20, the clam shell halves 421*a* and 421*b* mate to define a first transmission housing chamber 433 and a second transmission housing chamber 435 disposed on either side of the ball bearing race 449. The first and second transmission housing chambers 433 and 435 are interconnected by channels 429*a* and 429*b*. The rear end of the hollow piston 458, cylindrical bearing 456, the crank pin 454 and crank plate 452 are disposed in the first transmission housing chamber 433. The majority of the spindle 448 and the over-load spring 458 are disposed in the second transmission housing chamber 435. Part of the spindle 448 in the second transmission housing chamber has a circumferential array of vent holes 448*a*. The vent holes 448*a* allow communication between the second transmission housing chamber 435 and a spindle chamber 448*b* located inside the spindle 448 in front of the hollow piston 458 and the ram 460.

In hammer mode, the hollow piston 458 is caused to reciprocate by the crank plate 452. When the hollow piston 458 moves into the first transmission housing chamber 433 air pressure in the first transmission housing chamber 433 increases due to the reduction in the volume of first transmission housing chamber caused by the arrival of the hollow piston. At the same time, the hollow piston 458 and the ram 460 move out of the spindle 448. This causes a decrease in air pressure in the spindle chamber 448*b* due to the increase in volume in the spindle chamber caused by the departure of the hollow piston and the ram. The second transmission housing chamber 435 is in communication with the spindle chamber 448*b*, via the vent holes 448*b*, and so the air pressure in the second transmission housing chamber 435 decreases too. The air pressure difference is equalised by air flowing from the first transmission housing chamber 433 through the overflow channels 429*a* and 429*b* and into the second transmission housing chamber 435 and the spindle chamber 448*b*.

Conversely, when the hollow piston 458 goes into the spindle 448, air pressure in the first transmission housing chamber 433 decreases due to the increase in the volume of first transmission housing chamber caused by the departure of the hollow piston. At the same time, this causes an increase in air pressure in the spindle chamber 448*b* due to the decrease in volume in the spindle chamber caused by the arrival of the hollow piston and the ram. As mentioned above, the second transmission housing chamber 435 is in communication with the spindle chamber 448*b*, via the vent holes 448*b*, and so the air pressure in the second transmission housing chamber 435 increases too. The air pressure difference is equalised by air flowing back from the second transmission housing chamber 435 and the spindle chamber 448*b* through the overflow channels 429*a* and 429*b* and into the first transmission housing chamber 433.

As a result of this cyclic back and forth movement of air in the overflow channels 429*a*, 429*b*, compression of the air is eliminated, or significantly reduced, during reciprocation of the hollow piston 58. As such, the hammer drive mechanism does less work and loses less energy through inadvertently compressing trapped air. This increases the efficiency of the motor and the battery life of the hammer drill.

Figure 25:
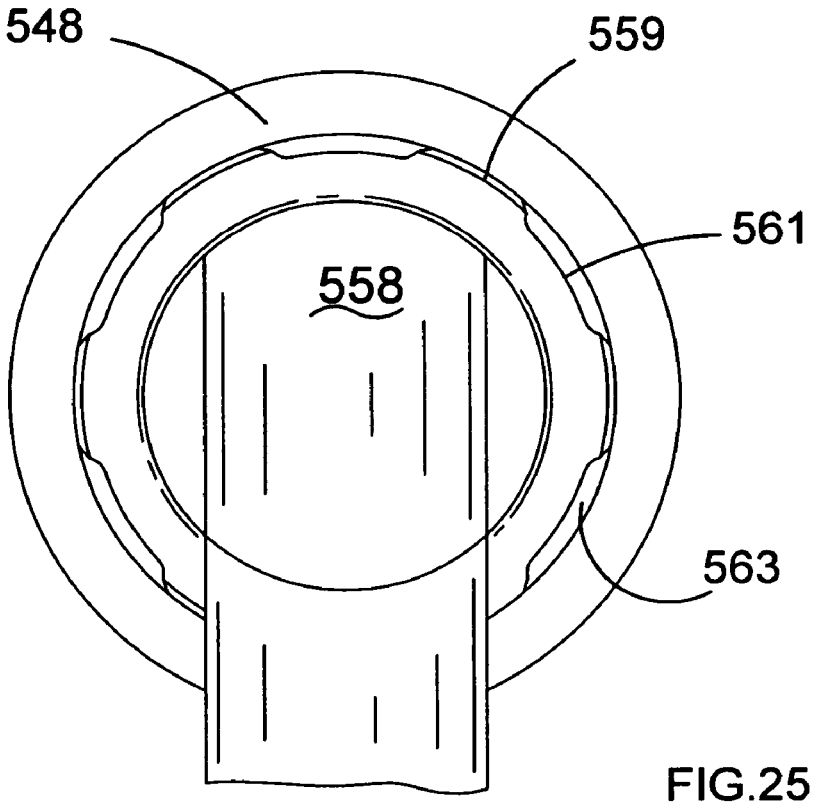
FIG. 25 is a rear view of a piston drive mechanism incorporating the hollow piston of FIGS. 24*a* to 24*d* mounted in a spindle.
Figure 26:
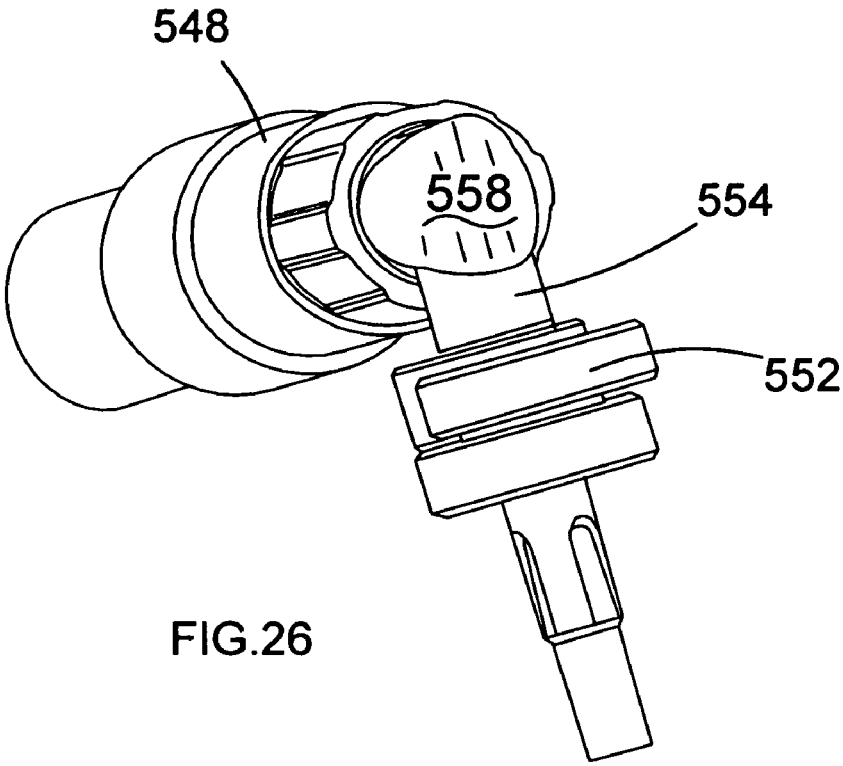
FIG. 26 is a perspective view from the rear of the piston drive mechanism of FIG. 25.

A hammer drill of a sixth embodiment of the invention has a hammer drive mechanism shown in FIGS. 24 to 26, with parts common to the embodiment of FIGS. 3 to 8 as denoted by like reference numerals but increased by 500.

Referring to FIGS. 24 to 26, a hollow piston 558 comprises a cylindrical bearing 556 that is adapted to receive a crank pin 554 in order to cause the hollow piston 558 to reciprocate inside the spindle 548. A ram (not shown) is slidably disposed inside the hollow piston 558 such that the ram is caused to execute a hammering action due to the air spring effect created inside hollow piston 558. A plurality of longitudinal ridges 559 are formed on the outer circumferential surface of the generally cylindrically-shaped hollow piston 558 to reduce the surface area of contact between the hollow piston 558 and the generally cylindrically-shaped spindle 548. A plurality of convex curvilinear shaped grooves 561 are formed in the gaps between the ridges. The grooves 561 circumscribe a cylinder of slightly reduced diameter than that of the outer circumferential surface of the hollow piston 558. As such, the grooves 561 are shallow enough to retain lubricant of normal viscosity throughout normal operation of the hammer drive mechanism.

The hollow piston 558 is slidably disposed inside the spindle 548. Rotation of crank plate 552 causes the crank pin 554 to act on cylindrical bearing 556 such that the hollow piston 558 reciprocates inside of the spindle 548. The spindle 548 may also rotate about the hollow piston 558. The longitudinal ridges 559 formed on the outer surface of the hollow piston 558 slidingly engage the inner surface of the spindle 548. It can be seen that the area of contact between the hollow piston 558 and the spindle 548 is reduced due to the engagement of only the ridges 559 with the inner surface of the spindle 548. The lubricant 563 contained in the grooves 561 reduces friction between the spindle 548 and the hollow piston 558. Air may also pass between the hollow piston 558 and the spindle, via the space created by the grooves 561, thereby improving cooling of the transmission mechanism. This air passage through the grooves may also assist in the equalisation of air pressure in the first and second transmission housing chambers 433, 435 already discussed under the heading of the fifth embodiment.

Figure 27:
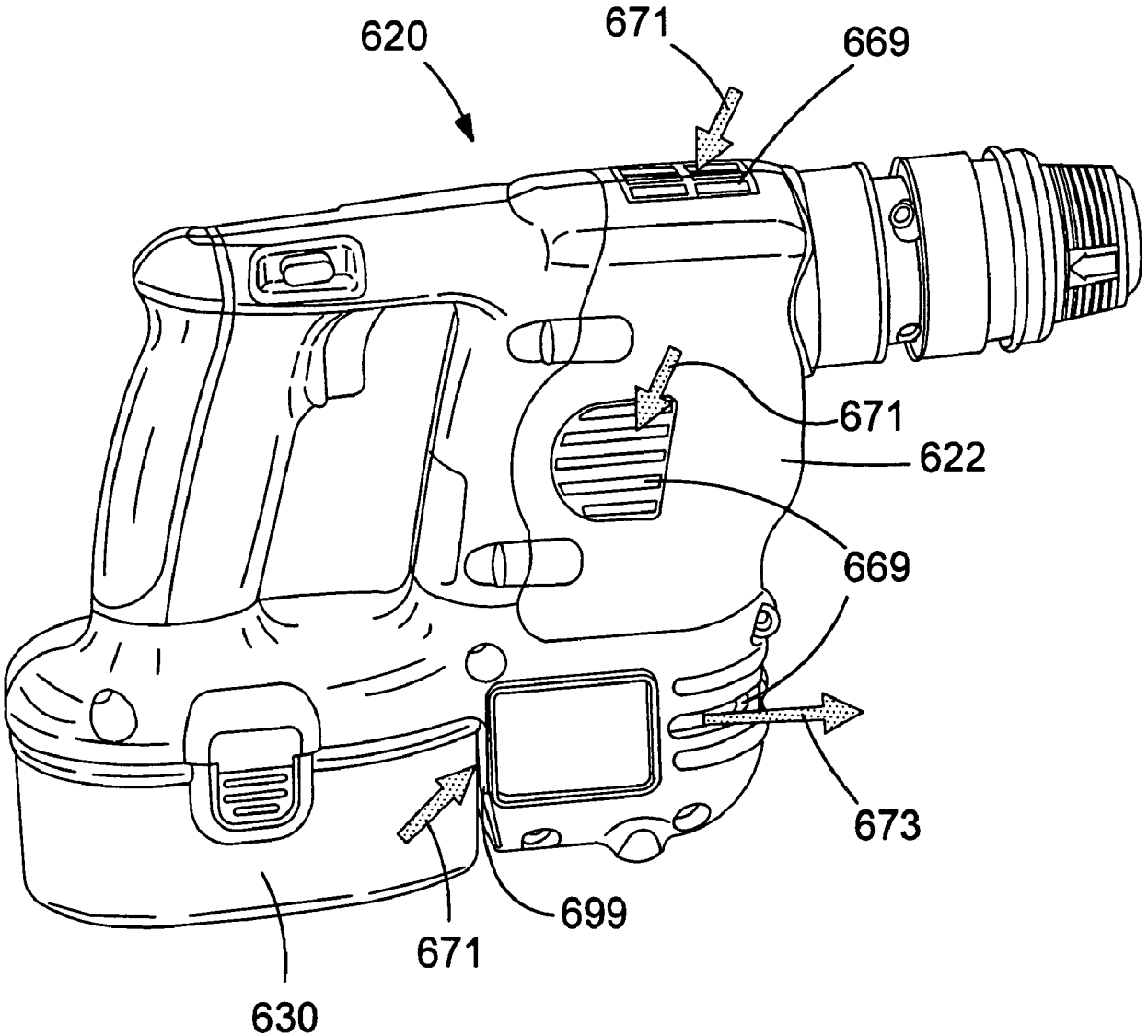
FIG. 27 is a side view of a hammer drill of a seventh embodiment of the present invention.
Figure 28:
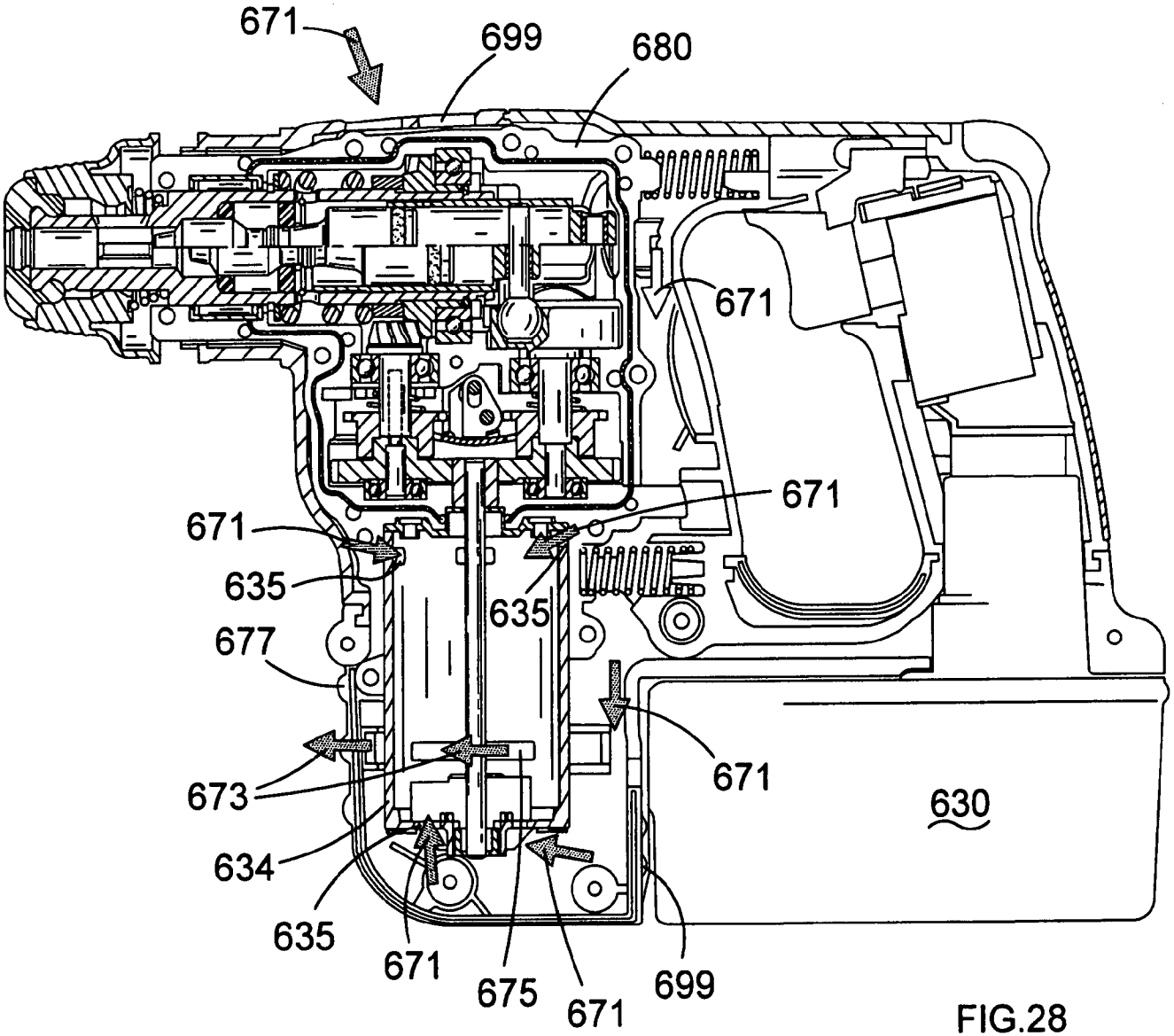
FIG. 28 is a side cross-sectional view of the hammer drill of FIG. 26.

A hammer drill of a seventh embodiment of the invention having a motor cooling system is shown in FIGS. 27 and 28, with parts common to the embodiment of FIGS. 3 to 8 denoted by like reference numerals but increased by 600.

A hammer drill 620 comprises a tool housing 622 in which a plurality of air vents 669 is formed. The air vents are adapted to either receive cool air from outside of the hammer drill or expel warm air from the inside of the hammer drill.

Referring to FIG. 28, a motor cooling fan (not shown) is disposed on the axis of the motor 634 in a position that is between the upper field coil (not shown) and the lower commutator (not shown) of the motor 634. A transmission housing 680, which may be of the two-part type or the three-part type described above, substantially encapsulates the transmission mechanism.

During operation of the power tool the cooling fan is driven by the motor. The cooling fan draws air axially through the motor and expels the air radially outwardly through holes 675 formed in the outer housing 677 of the motor 634. The cooling fan is vertically aligned with the holes 675 to make the radial expulsion of air easier. This causes air to be drawn in through the air vents 669 formed on the top of the housing 622, in the side of the housing 622 and between the housing 622 and the battery pack 630. The cool air follows a path through the tool housing 622 shown by cool air arrows 671. The cool air flows around the outside of the transmission housing 680 but inside the tool housing 622 such that air does not pass through the transmission mechanism which is sealed to prevent ingress of dirt.

A plurality of motor openings 635 are formed in the outer housing 677 of the motor 634 to enable cool air to pass into the motor to cool the motor. As a result of the position of the cooling fan, cool air is drawn across both the field coils of the motor and the motor commutator such that each of these components is individually cooled by air flowing downwards over the field coils and upwards over the commutator. Warm air is expelled through a front vent 669 in the front of the housing following a path shown by warm air arrows 673. The front vent 699 is vertically aligned with the holes 675 in the outer housing 677 of the motor 634. Warm air may also be expelled through a rear vent 699 that is disposed between the tool housing 622 and the releasable battery pack 630.

It will be appreciated by persons skilled in the art that the above embodiment has been described by way of example only and not in any limitative sense, and that various alterations and modifications are possible without departure from the scope of the invention as defined by the appended claims.

The invention claimed is:

1. A power tool comprising:

an outer housing for gripping by a user;

a motor disposed in the outer housing and including an output shaft;

a transmission mechanism including:

a hollow cylinder;

a piston mounted for reciprocating motion within the cylinder;

a ram mounted for reciprocating motion within the cylinder and located forward of the piston; and a space defined within the cylinder and between the piston and the ram and serving as an air spring for transmitting the reciprocating motion of the piston to the ram, a transmission housing located within the outer housing and substantially enclosing the transmission mechanism the transmission housing including an interior support structure for supporting the hollow cylinder within the transmission housing, and wherein the transmission housing, the hollow cylinder, and the piston substantially define a first chamber rearward of the support structure; and the transmission housing, the hollow cylinder, and the ram substantially define a second chamber forward of the support structure and separate from the first chamber; and a channel pneumatically connecting the first chamber and the second chamber in order to allow air flow between the first chamber and the second chamber to reduce pressure differences generated by the reciprocation of the piston within the first chamber.

2. A power tool according to claim 1, wherein the transmission housing is formed from a plurality of clamshell portions.

3. A power tool according to claim 2, wherein at least one clamshell portion defines the channel.

4. A power tool according to claim 1, further comprising a plurality of internal guide rails on which the transmission housing is slidably mounted within the outer housing.

5. A power tool according to claim 1, further comprising biasing means for damping vibrations of the transmission mechanism transmitted to the outer housing.

6. A power tool according to claim 5, wherein the biasing means comprises at least one coil spring.

7. A power tool according to claim 1, wherein the power tool is a hammer drill.

8. A power tool comprising:

an outer housing for gripping by a user;

a motor disposed in the outer housing and including an output shaft;

a transmission mechanism including:

a hollow cylinder;

a hollow piston mounted for reciprocating motion within the cylinder;

a ram mounted for reciprocating motion within the hollow piston; and a space defined by the hollow piston and the ram and serving as an air spring for transmitting the reciprocating motion of the piston to the ram, a transmission housing located within the outer housing and substantially enclosing the transmission mechanism the transmission housing including an interior support structure for supporting the hollow cylinder within the transmission housing, and wherein the transmission housing, the hollow cylinder, and the piston substantially define a first chamber rearward of the support structure; and the transmission housing, the hollow cylinder, and the ram substantially define a second chamber forward of the support structure and separate from the first chamber; and a channel pneumatically connecting the first chamber and the second chamber in order to allow air flow between the first chamber and the second chamber to reduce pressure differences generated by the reciprocation of the piston within the first chamber.

9. A power tool according to claim 8, wherein the transmission housing is formed from a plurality of clamshell portions.

10. A power tool according to claim 9, wherein at least one clamshell portion defines the channel.

11. A power tool according to claim 8, further comprising a plurality of internal guide rails on which the transmission housing is slidably mounted within the outer housing.

12. A power tool according to claim 8, further comprising biasing means for damping vibrations of the transmission mechanism transmitted to the outer housing.

13. A power tool according to claim 12, wherein the biasing means comprises at least one coil spring.

14. A power tool according to claim 8, wherein the hollow cylinder is an output spindle rotatably mounted within the transmission housing.

15. A power tool according to claim 14, wherein the support structure includes a bearing race located circumferentially around the output spindle and rotatably supporting the output spindle.

16. A power tool according to claim 14, wherein the output spindle defines an interior bore and the ram reciprocates into the interior bore.

17. A power tool according to claim 16, wherein the output spindle defines a vent hole pneumatically connecting the interior bore and the second chamber.

18. A power tool according to claim 14, wherein the transmission mechanism is a first reciprocating transmission mechanism and the power tool further comprises a second rotary transmission mechanism substantially located within the transmission housing for selectably driving the output spindle in rotation.

19. A power tool according to claim 18, wherein the second rotary transmission includes a driven gear located circumferentially around the output spindle between the first chamber and the second chamber.

20. A power tool according to claim 19, wherein the channel is defined by the transmission housing.

21. A power tool according to claim 20, wherein the transmission housing is formed from a plurality of clamshell portions.

* * * * *